US011050160B2

(12) United States Patent
Zhang et al.

(10) Patent No.: US 11,050,160 B2
(45) Date of Patent: Jun. 29, 2021

(54) PLANAR-SHAPED ANTENNA DEVICES, ANTENNA ARRAYS, AND FABRICATION

(71) Applicant: University of Massachusetts, Boston, MA (US)

(72) Inventors: Hualiang Zhang, Arlington, MA (US); Bowen Zheng, Dracut, MA (US)

(73) Assignee: University of Massachusetts, Boston, MA (US)

( * ) Notice: Subject to any disclaimer, the term of this patent is extended or adjusted under 35 U.S.C. 154(b) by 425 days.

(21) Appl. No.: 15/953,739

(22) Filed: Apr. 16, 2018

(65) Prior Publication Data

US 2018/0301814 A1 Oct. 18, 2018

Related U.S. Application Data

(60) Provisional application No. 62/486,133, filed on Apr. 17, 2017.

(51) Int. Cl.

| | |
|---|---|
| ***H01Q 19/00*** | (2006.01) |
| ***H01Q 15/14*** | (2006.01) |
| ***H01Q 19/185*** | (2006.01) |
| *H01P 1/203* | (2006.01) |
| *H01Q 5/42* | (2015.01) |
| *H01Q 21/06* | (2006.01) |

(52) U.S. Cl.

CPC ..... *H01Q 19/005* (2013.01); *H01Q 15/14* (2013.01); *H01Q 19/185* (2013.01); *H01P 1/2039* (2013.01); *H01Q 5/42* (2015.01); *H01Q 21/064* (2013.01)

(58) Field of Classification Search

CPC .... H01Q 19/005; H01Q 19/10; H01Q 19/104; H01Q 19/108; H01Q 19/18; H01Q 19/185; H01Q 19/195; H01Q 15/14–23; H01Q 25/002; H01Q 25/005; H01Q 5/42; H01Q 21/0075; H01Q 21/064; H01Q 21/065; H01Q 13/10–18; H01Q 9/02; H01Q 9/04; H01Q 9/0407–0478; H01Q 1/246; H01Q 1/38; H01Q 1/52; H01Q 1/521; H01Q 1/523; H01Q 1/525; H01P 1/2039

See application file for complete search history.

(56) References Cited

U.S. PATENT DOCUMENTS 5,001,492 A * 3/1991 Shapiro ..... H01P 5/187 333/116
8,686,914 B2 * 4/2014 Lin ..... H01Q 19/06 343/700 MS
10,135,133 B2 * 11/2018 Wu ..... H01Q 15/0013

* cited by examiner

*Primary Examiner* — Dimary S Lopez Cruz
*Assistant Examiner* — Patrick R Holecek
(74) *Attorney, Agent, or Firm* — Armis IP Law, LLC

(57) ABSTRACT

An antenna device as described herein includes a first metal layer and a second metal layer. The second metal layer is spaced apart from the first metal layer. The first metal layer includes an opening through which to transmit RF (Radio Frequency) energy to the second metal layer. The second metal layer is operable to reflect the RF energy received through the opening back to a surface of the first metal layer. The first metal layer is operable to reflect the RF energy (received from the reflection off the second metal layer) in a direction past the second metal layer through a communication medium. The surface area of the first metal layer is sufficiently larger than a surface area of the second metal layer to reflect the RF energy past the second metal layer into the communication medium. This ensures that the antenna device operates in a reflective mode as opposed to a resonant mode, resulting in high gain.

34 Claims, 22 Drawing Sheets

TOP VIEW

PLANAR-SHAPED ANTENNA DEVICES, ANTENNA ARRAYS, AND FABRICATION

RELATED APPLICATIONS

This application is related to and claims the benefit of earlier filed U.S. Provisional Patent Application Ser. No. 62/486,133 entitled "PLANAR-SHAPED ANTENNA DEVICE AND ANTENNA ARRAYS," filed on Apr. 17, 2017, the entire teachings of which are incorporated herein by this reference.

GOVERNMENT RIGHTS

This invention was made with Government support under Award No. N00014-17-1-2008 awarded by the Office of Naval Research. The government may have certain rights in the invention.

BACKGROUND

Conventional antenna devices have been used to convey RF energy to a target recipient. For example, one type of antenna device is a so-called patch antenna.

A patch antenna (also known as a rectangular microstrip antenna) is a type of radio antenna with a low profile, which can be mounted on a flat surface. It consists of a flat rectangular sheet or "patch" of metal, mounted over a larger sheet of metal called a ground plane. They are the original type of microstrip antenna in which two metal sheets together form a resonant piece of microstrip transmission line with a length of approximately one-half wavelength of the radio waves. The radiation mechanism in a microstrip line arises from discontinuities at each truncated edge of the microstrip transmission line. The radiation at the edges causes the antenna to act slightly larger electrically than its physical dimensions, so in order for the antenna to be resonant, a length of microstrip transmission line slightly shorter than one-half a wavelength at the frequency is used.

BRIEF DESCRIPTION OF EMBODIMENTS

Conventional patch antennas suffer from deficiencies. For example, a conventional patch antenna may be substantially planar and suitable for use on a respective printed circuit board. However, conventional patch antennas operate in a resonant mode, rendering the conventional patch antenna unable to operate in a high gain mode. In other words, although planar in nature, a conventional patch antenna does not provide high signal gain, limiting its usefulness in many wireless applications.

This disclosure further includes the observation that conventional antennas such as reflector antennas, horn antennas, etc., may provide high gain. However, such antennas are heavy, bulky, and large in profile, which results in high manufacturing costs and difficulty for fabrication and integration.

In contrast to conventional antenna devices, embodiments herein include a novel planar, high-gain antenna. The substantially planar antenna devices described herein are lightweight, low-cost, and easily integrated/fabricated on a respective circuit board or other suitable substrate.

More specifically, in one example embodiment, the antenna device as described herein includes a first metal layer and a second metal layer. The second metal layer is spaced apart from the first metal layer. The first metal layer includes an opening (such as a slot or other shape) through which to transmit RF (Radio Frequency) energy to the second metal layer. The second metal layer is operable to reflect the RF energy received through the opening back to a surface of the first metal layer. The first metal layer is operable to reflect the RF energy (received from the reflection off the second metal layer) in a direction past the second metal layer through a communication medium such as air to a target recipient.

A combination of the first metal layer and the second metal layer form a highly directional antenna in which a main lobe of the directional antenna radiates in a direction approximately orthogonal to a planar surface of the first metal layer and the second metal layer.

In accordance with further embodiments, a planar surface area of the first metal layer is disposed orthogonal with respect to a direction of the RF energy passing through the opening to the second metal layer. The surface area of the first metal layer is sufficiently larger than a surface area of the second metal layer to reflect the RF energy past the second metal layer into the communication medium. In other words, in one embodiment, the first metal layer is operable to reflect RF energy such that at least a portion of it (the reflected energy) passes outside a periphery of the second metal layer (as opposed to being blocked or reflected again by the second metal layer which would cause resonance).

In yet further embodiments, a surface area of the first metal layer is substantially greater than a surface area of the second metal layer; the first metal layer and the second metal layer are planar and disposed in parallel with respect to each other. For example, in accordance with more specific embodiments, the surface area of the first metal layer is at least 3 times greater than a surface area of the second metal layer. This helps to ensure that the antenna device operates in a reflective mode as opposed to a resonant mode. In other words, when the surface area of the first metal layer is sufficiently larger (at least twice as large) than a surface area of the second metal layer, the combination of the first metal layer and the second metal layer operate in a non-resonant operational mode to convey RF energy in a desired direction from the antenna device.

As previously discussed, the opening in the first metal layer can be a slot or other suitable shaped opening. The second metal layer is disposed directly above the slot (such as on a different substrate) to reflect energy received from the slot back to a facing of the first metal layer. In accordance with further embodiments, the slot is wider than the width of the second metal surface.

In accordance with further embodiments, a lengthwise axis of the slot is disposed perpendicular to a transmission line (such as a microstrip line) on which RF energy is conveyed from a driver circuit to the opening in the first metal layer.

The thickness of a spacer separating the first metal layer and the second metal layer can be any suitable value such that the corresponding antenna device including a combination of the first metal layer, spacer (such as air), and the second metal layer is substantially planar. In one embodiment, the space separating the first metal layer and the second metal layer is less than 25% of the wavelength of the RF energy transmitted through the opening.

The antenna device as described herein can be disposed on any suitable substrate. In one embodiment, the first metal layer is disposed on a printed circuit board. The second metal layer is fabricated above the first metal layer.

Further, note that the antenna device as described herein can be used individually and as a source from which to transmit or receive RF energy.

Additionally, in accordance with further embodiments, multiple planar antenna devices as described herein can used as a feeding antenna such as for transmitarray and reflectarray antennas.

Horn antennas or open-ended waveguides are typically used as feeding antennas for transmitarray and reflectarray antennas. In such an instance, the distance from the feeding antenna to the array is very large (e.g. several wavelengths). As a result, conventional transmitarray and reflectarray are typically bulky and heavy. Using an array of antenna devices as a feeding antenna (instead of horn antennas or open-ended waveguides), the distance from the feeding antenna to the array can be reduced by a factor of 10 or more (e.g. because the antenna devices described herein is sub-wavelength in size).

Further embodiments herein include a fabricator (such as manufacturing facility, assemblers, technicians, machines, computers, etc.) operable to fabricate a surface area of the first metal layer to be orthogonal to a direction in which to receive the RF energy through the opening (slot), the surface area of the first metal layer is sufficiently larger than a surface area of the second metal layer to reflect the RF energy past the second metal layer to a target device in a communication medium. In one embodiment, as previously discussed, the fabricator fabricates a surface area of the first metal layer to be at least 3 times greater than a surface area of the second metal layer.

In accordance with further embodiments, the fabricator is operable to fabricate the first metal layer and the second metal layer fabricated to be planar and disposed in parallel with respect to each other.

In yet further embodiments, the fabricator is operable to fabricate a surface area of the first metal layer to be sufficiently larger than a surface area of the second metal layer such that the combination of the first metal layer and the second metal layer operate in a non-resonant operational mode. The fabricator disposes the second metal layer directly above the slot.

In yet further embodiments, the fabricator is operable to dispose a lengthwise axis of the slot to be disposed perpendicular to a transmission line on which the RF energy is conveyed from a driver circuit to the opening (slot).

Further embodiments herein include fabricating a combination of the first metal layer and the second metal layer to form a directional antenna in which a main lobe of the directional antenna extends in an orthogonal direction from a planar surface of the first metal layer.

In still further embodiments, the fabricator fabricates the first metal layer to convey at least a portion of the RF energy outside a periphery of the second metal layer to a communication medium.

In accordance with further embodiments, the fabricator: couples the first metal layer to a ground reference voltage; receives a substrate including a first facing and a second facing; disposes the first metal layer on the first facing of the substrate; and disposes a feed line (feed network) on the second facing, the feed line operable to convey a signal to the opening to transmit the RF energy.

In still further embodiments, the opening is a first opening in the first metal layer; the RF energy is first RF energy. The fabricator method further performs operations of: fabricating a third metal layer to be spaced apart from the first metal layer; and disposing a second opening in the first metal layer, the second opening operable to transmit second RF (Radio Frequency) energy to the third metal layer, the third metal layer operable to reflect the second RF energy received through the second opening back to the first metal layer, the first metal layer operable to reflect the second RF energy from the third metal layer in a direction past the third metal layer to the communication medium.

In yet further embodiments, in a so-called wide band configuration, the third metal layer resides in a same plane as the second metal layer; and the first metal layer is planar, both the second metal layer and the third metal layer parallel to the first metal layer. The fabricator: disposes a substrate between the first metal layer and a combination of the second metal layer and the third metal layer; fabricates a fifth metal layer on the substrate to be disposed between the first metal layer and the third metal layer; and fabricates a sixth metal layer on the substrate to be disposed between the first metal layer and the fourth metal layer.

In still further embodiments, a combination of the first opening, the first metal layer, and the second metal layer are operable to output the first RF energy at a first carrier frequency; and a combination of the second opening, the first metal layer, and the third metal layer are operable to support output the first RF energy at a second carrier frequency.

In one embodiment, the fabricator: fabricates the second metal layer as a first patch antenna element operable to support emission of the first RF energy; and fabricates the third metal layer as a second patch antenna element of multiple patch antenna elements that are collectively operable to support emission of the second RF energy. As previously discussed, the fabricator can be configured to fabricate the first patch antenna element to be substantially larger in surface area size than the second patch antenna element.

These and other more specific embodiments are disclosed in more detail below.

Note that any of the resources as discussed herein can include one or more computerized devices, mobile playback devices, servers, base stations, wireless playback equipment, playback management systems, workstations, handheld or laptop computers, or the like to carry out and/or support any or all of the method operations disclosed herein. In other words, one or more computerized devices or processors can be programmed and/or configured to operate as explained herein to carry out the different embodiments as described herein.

Yet other embodiments herein include software programs to perform the steps and operations summarized above and disclosed in detail below. One such embodiment comprises a computer program product including a non-transitory computer-readable storage medium (i.e., any computer readable hardware storage medium or hardware storage media disparately or co-located) on which software instructions are encoded for subsequent execution. The instructions, when executed in a computerized device (hardware) having a processor, program and/or cause the processor (hardware) to perform the operations disclosed herein. Such arrangements are typically provided as software, code, instructions, and/or other data (e.g., data structures) arranged or encoded on a non-transitory computer readable storage media such as an optical medium (e.g., CD-ROM), floppy disk, hard disk, memory stick, memory device, etc., or other a medium such as firmware in one or more ROM, RAM, PROM, etc., and/or as an Application Specific Integrated Circuit (ASIC), etc. The software or firmware or other such configurations can be installed onto a computerized device to cause the computerized device to perform the techniques explained herein.

Accordingly, embodiments herein are directed to a method, system, computer program product, etc., that supports operations as discussed herein.

One embodiment includes a computer readable storage media and/or a system having instructions stored thereon to facilitate fabrication of an antenna device as discussed herein. For example, in one embodiment, the instructions, when executed by computer processor hardware, cause the computer processor hardware (such as one or more processor devices) to: fabricate a first metal layer; fabricate a second metal layer; space the first metal layer from the second metal layer; produce the first metal layer to include an opening through which to transmit RF (Radio Frequency) energy to the second metal layer, the second metal layer operable to reflect the RF energy received through the opening back to the first metal layer, the first metal layer operable to reflect the RF energy off the second metal layer in a direction past the second metal layer to a communication medium.

The ordering of the steps above has been added for clarity sake. Note that any of the processing steps as discussed herein can be performed in any suitable order.

Other embodiments of the present disclosure include software programs and/or respective hardware to perform any of the method embodiment steps and operations summarized above and disclosed in detail below.

It is to be understood that the system, method, apparatus, instructions on computer readable storage media, etc., as discussed herein also can be embodied strictly as a software program, firmware, as a hybrid of software, hardware and/or firmware, or as hardware alone such as within a processor (hardware or software), or within an operating system or a within a software application.

As discussed herein, techniques herein are well suited for use in the field of content playback and specifically identification of desirable and undesirable portions of content. Moreover, embodiments herein impact all applications involving transmitting/receiving electromagnetic signals with improved performance (e.g. higher data rate) and reduced cost, size and weight. A few examples are listed below: 5G wireless communication systems, satellite and space communication systems, automobile radar systems, wireless network on chips (e.g. chip to chip communication), phased array systems (operating at the frequency bands of RF/microwave, millimeter-wave, THz, infrared, and visible). However, it should be noted that embodiments herein are not limited to use in such applications and that the techniques discussed herein are well suited for other applications as well.

Additionally, note that although each of the different features, techniques, configurations, etc., herein may be discussed in different places of this disclosure, it is intended, where suitable, that each of the concepts can optionally be executed independently of each other or in combination with each other. Accordingly, the one or more present inventions as described herein can be embodied and viewed in many different ways.

Also, note that this preliminary discussion of embodiments herein purposefully does not specify every embodiment and/or incrementally novel aspect of the present disclosure or claimed invention(s). Instead, this brief description only presents general embodiments and corresponding points of novelty over conventional techniques. For additional details and/or possible perspectives (permutations) of the invention(s), the reader is directed to the Detailed Description section and corresponding figures of the present disclosure as further discussed below.

Figure 1:
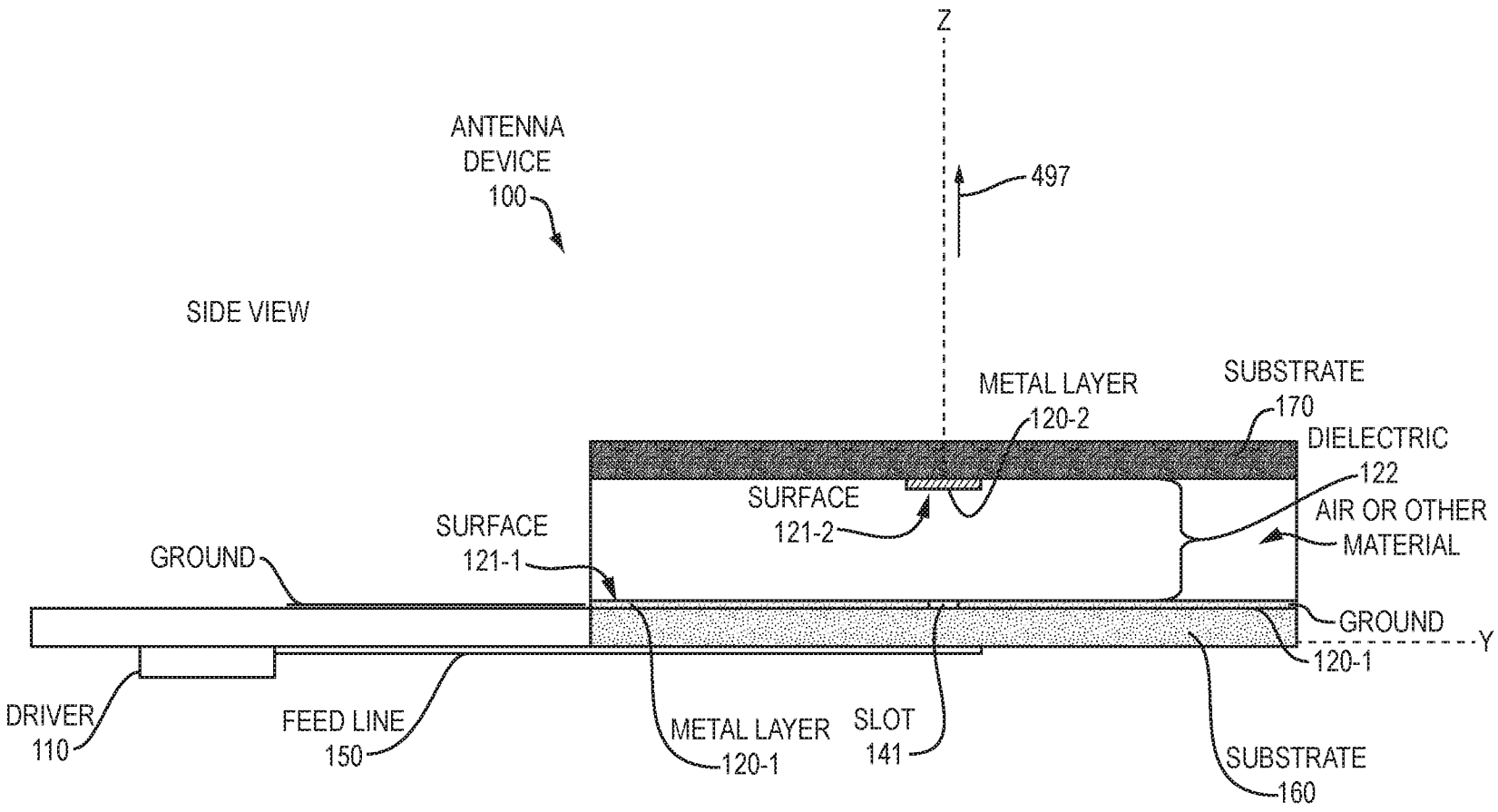
FIG. 1 is an example diagram illustrating a side view of a wireless antenna device according to embodiments herein.

The foregoing and other objects, features, and advantages of the invention will be apparent from the following more particular description of preferred embodiments herein, as illustrated in the accompanying drawings in which like reference characters refer to the same parts throughout the different views. The drawings are not necessarily to scale, with emphasis instead being placed upon illustrating the embodiments, principles, concepts, etc.

DETAILED DESCRIPTION

Now, more specifically, with reference to the figures, FIG. 1 is an example diagram illustrating a side view of an antenna device according to embodiments herein.

In this example embodiment, antenna device 100 includes a first metal layer 120-1 disposed on surface 121-1 (reflector) of substrate 160. The antenna device 100 also includes a second metal layer 120-2 disposed on surface 121-2 (patch antenna element) disposed on substrate 170.

As shown, the metal layer 120-2 is spaced apart (such as using a dielectric material or air) from metal layer 120-1; a surface 121-2 of metal layer 120-2 faces the surface 121-1 of the metal layer 120-1.

Each of the metal layers 120 can be fabricated from any suitable combination of one or more metals such as copper, aluminum, tin, etc.

Each of the substrate 160 and 170 can be fabricated from any suitable dielectric material such as ceramic, epoxy, etc.

In general, dielectric material is insulating material or a very poor conductor of electric current. When dielectric material is placed in an electric field, practically no current flows in them because, unlike metals, they have no loosely bound, or free, electrons that may drift through the material.

Further in this example embodiment, as further described herein, a surface area of the metal layer 120-1 is sufficiently greater in size than a surface area of the metal layer 120-2 to emit wireless energy in a direction as indicated by the Z-axis (or, more specifically, direction 497).

As previously discussed, in contrast to conventional antenna devices, antenna device 100 is a novel multi-layer, substantially planar, non-resonant (or reflective), type of high-gain antenna. In contrast to conventional antenna devices, such a planar antenna device (apparatus, system, etc.) is light-weight, low-cost, and easily integrated/fabricated on a respective circuit board or other suitable substrate.

As further shown, the antenna device 100 can be driven using driver 110. The driver 110 can be disposed on the substrate 160 or other suitable substrate.

Feed line 150 (such as a microstrip line, waveguide, or feeding network, etc.) conveys RF energy from the driver 110 to the slot 141 (opening) of the antenna device 100. As further discussed herein, the antenna device 100 outputs wireless RF energy substantially in a direction 497 as indicated by the z-axis.

In accordance with further embodiments, the substrate 160 is a printed circuit board substrate (non electrically conductive and/or insulation-type material such as one or more layers of epoxy and traces) on which the antenna device 100 is fabricated.

In one embodiment, the metal layer 120-1 is connected to a ground voltage reference.

As further shown in FIG. 1, metal layer 120-2 is disposed directly over the slot 141 (such as an opening, gap, channel, port, window, etc.). In one embodiment, the slot 141 is an opening in which to launch RF energy in a direction toward the metal layer 120-2.

In accordance with further embodiments, as previously discussed, the metal layer 120-2 is spaced apart with respect to the first metal layer 120-1 via the dielectric layer 122 (insulator such as air or other non-conducting or nearly non-conducting material).

As further described herein, a combination of the first metal layer 120-1 and the second metal layer 120-2 combine to form directional antenna device 100 in which the beam of the directional antenna 100 radiates substantially in a direction orthogonal to planar surface 121-1 (generally along z-axis and direction 497). Thus, a planar surface 121-1 area of the first metal layer 120-1 is disposed orthogonal with respect to a direction 497 of RF energy passing through the slot 141 to the second metal layer 120-2.

Figure 2:
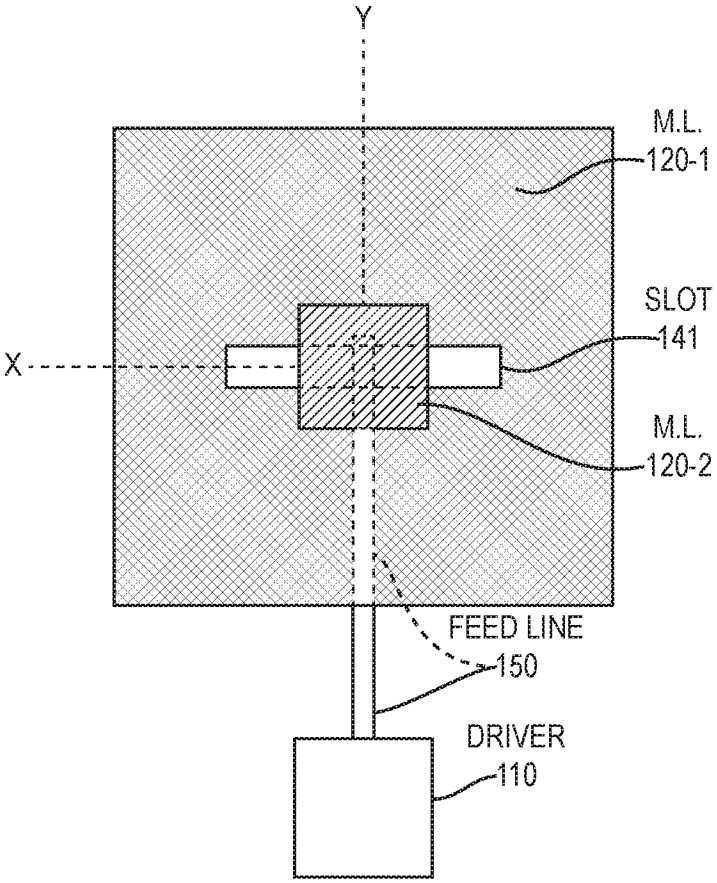
FIG. 2 is an example diagram illustrating a top view of a wireless antenna device according to embodiments herein.

FIG. 2 is an example diagram illustrating a top view of a wireless antenna device and stacking of a second metal layer with respect to a first metal layer according to embodiments herein.

As shown, the surface area of the first metal layer 120-1 (as viewed along z-axis) is sufficiently and/or substantially larger than a surface area of the second metal layer 120-2.

In general, slot 141 emits wireless RF energy to the metal layer 120-2. Metal layer 120-2 reflects the RF energy to the metal layer 120-1. The metal layer 120-2 reflects the energy from metal layer 120-2 in a direction substantially along the z-axis into a respective communication medium such as air.

Each of the metal layer 120-1 and metal layer 120-2 can be any suitable sized surface area. In one embodiment, as shown, the surface area of the metal layer 120-1 is at least 3 times larger than a surface area of the metal layer 120-2.

As previously discussed, the slot 141 can be any suitable shaped opening. In one embodiment, the slot 141 (opening) is rectangular.

As further shown, in one embodiment, the second metal layer 120-2 is disposed directly above and centered with respect to the slot 141. This enables surface 121-2 of the metal layer 120-2 to reflect RF energy received from the slot 141 (i.e., opening) back to a facing (surface 121-1) of the first metal layer 120-1. Alternatively, note that the second metal layer 120-2 can be offset with respect to the slot 141.

In accordance with further embodiments, a lengthwise axis (such as along the x-axis) of the slot 141 is disposed perpendicular to a lengthwise axis (y-axis) of the feedline 150 (such as a microstrip line or other suitable transmission line) on which RF energy is conveyed from the driver 110 to the slot 141 of the first metal layer 120-1.

As further shown, by way of non-limiting example embodiment, the length of slot 141 is greater in size (along the x-axis) than the width of the second metal layer 120-2 along the x-axis. As further shown, in one embodiment, the width of slot 141 along the y-axis is substantially smaller in size than the width of the second metal layer 120-2 along the x-axis.

The length and width of the slot 141 can be any suitable values and vary depending on the embodiment.

Figure 3:
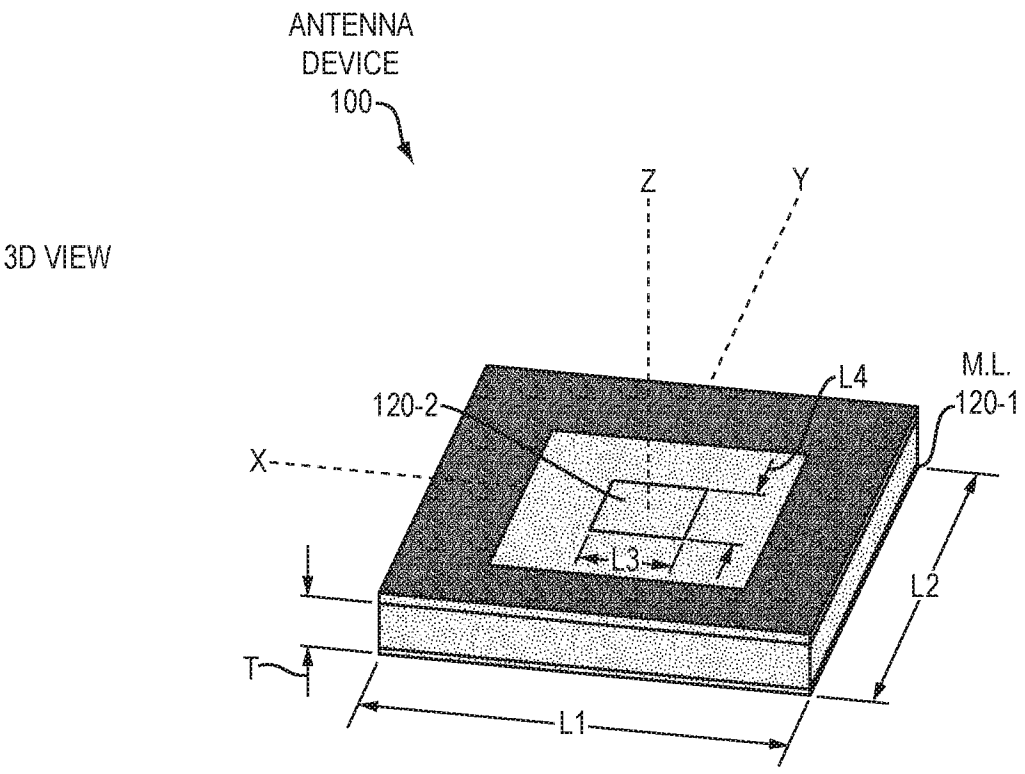
FIG. 3 is an example diagram illustrating a three-dimensional view of a wireless antenna device according to embodiments herein.

FIG. 3 is an example diagram illustrating a three-dimensional view of the antenna device according to embodiments herein.

As shown in FIG. 3, the second metal layer 120-2 is spaced apart with respect to the first metal layer 120-1 by the thickness, T.

Assume that the wavelength value, WL (or Lambda), represents a wavelength of a corresponding RF signal conveyed from the driver 110 over the feedline 150 to the slot 141.

In accordance with certain embodiments, the thickness or spacing, T, can be set to any suitable dimension. In one embodiment, the thickness or spacing, T, is set to a value such as between 0.001 and 0.5*WL or greater; the length L1 and L2 can be any suitable dimension such as greater than 0.125*WL; the length L3 and L4 can be any suitable dimension such as greater than 0.1*WL.

By way of non-limiting example embodiment, assume in this example embodiment that the frequency of the corresponding RF signal is 5 GHz. In such an instance, the wavelength is approximately 60 mm (millimeters). Each of the lengths L1 and L2 are each 50 mm (0.83*WL). Each of the lengths L3 and L4 are each 21.8 mm (0.36*WL). The thickness T is 7.4 mm (0.12*WL).

However, as previously discussed, these values may vary depending on the embodiment.

Note further that the thickness, T, of the spacer (or spacing) separating the first metal layer 120-1 and the second metal layer 120-2 can be any suitable value such that a shape of the corresponding antenna device 100 including a combination of the first metal layer 120-1 and the second metal layer 120-2 is substantially planar. In other words, the thickness is relatively small compared to L1 and/or L2.

In one embodiment, respective spacer material, air, vacuum, etc., separating the first metal layer 120-1 and the second metal layer 120-2 is less than 25% of the wavelength of the RF energy transmitted through the slot 141.

When the surface area (L1×L2) of the first metal layer 120-1 is sufficiently larger than a surface area (L3×L4) of the second metal layer 120-2, the combination of the first metal layer 120-1 and the second metal layer 120-2 operate in a non-resonant or reflective operational mode to convey a respective RF energy in a desired direction from the antenna device 100.

As previously discussed, in one embodiment, the surface area of the first metal layer 120-1 in the X-Y plane is at least 3 times greater than a surface area of the second metal layer 120-2 in the X-Y plane. This ensures that the antenna device 100 operates in a reflective mode as opposed to a resonant mode.

Figure 4:
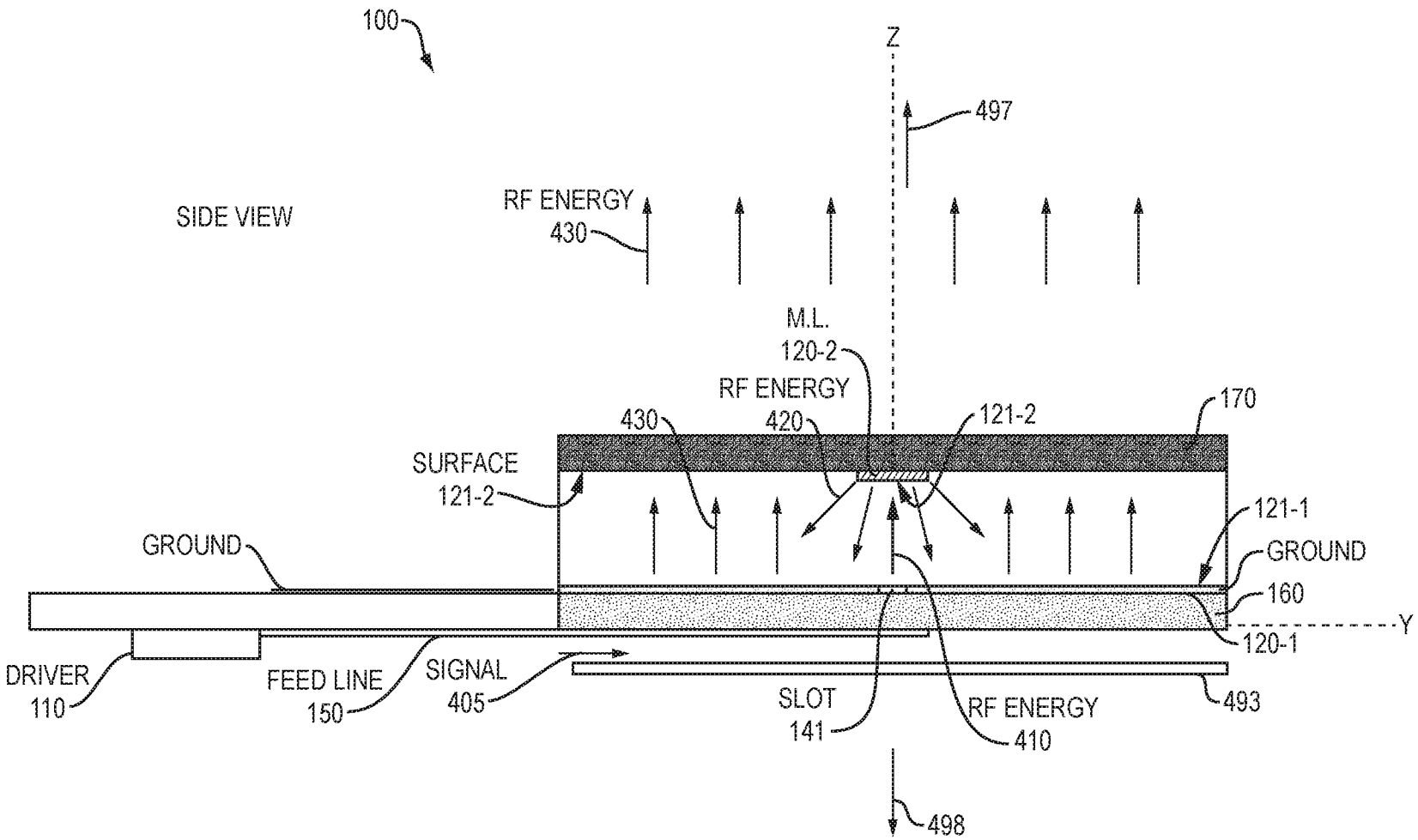
FIG. 4 is an example diagram illustrating operation of the wireless antenna device according to embodiments herein.

FIG. 4 is an example diagram illustrating reflective operation of the wireless antenna device according to embodiments herein.

In this example embodiment, the driver 110 transmits the signal 405 through the feedline 150 to the slot 141.

The energy associated with the signal 405 wirelessly passes through the slot 141 (opening) of the first metal layer 120-1 as wireless RF energy 415. The RF energy 415 strikes the surface 121-2 of the second metal layer 120-2.

The second metal layer 120-2 reflects the received RF energy 410 as RF energy 420 back to the surface 121-1 of the metal layer 120-1. As further shown, the surface 121-1 of the metal layer 120-1 reflects the received RF energy 420 as reflected RF energy 430 (in the Z-axis, or direction 497) to a communication medium such as air.

Note that the antenna device 100 can include additional metal layer 493 (spaced from substrate 160) to reduce an amount of RF energy transmitted from antenna device 100 in direction 498.

In one embodiment, because the surface area 121-2 of the second metal layer 120-2 is substantially smaller than the surface area of surface 121-1 of metal layer 120-1, the surface 121-1 of the first metal layer 120-1 is operable to reflect the RF energy 420 such that corresponding RF energy 430 passes outside a periphery (peripheral edges) of the second metal layer 120-2 (as opposed to being blocked or reflected again by the second metal layer 120-2) to a respective communication medium such as air to a recipient.

Further, note that the antenna device 100 as described herein can be used individually, and as a source from which to transmit or receive RF energy.

Additionally, in accordance with further embodiments, multiple planar antenna devices (similar to antenna device 100) as described herein can be can be formed as an array for use as a feeding antenna for transmitarray and reflectarray antennas.

Note that conventional horn antennas or open-ended waveguides are typically used as feeding antennas for transmit array and reflect array antennas. In such a conventional instance, the distance from the feeding antenna to the array is very large (e.g. several wavelengths). As a result, conventional transmit array and reflect array are typically bulky and heavy.

In contrast to conventional arrays, using an array of antenna device 100 (apparatus, system, etc.) as a feeding antenna (instead of horn antennas or open-ended waveguides), the distance from the feeding antenna to the array can be reduced by a factor of 10 or more (e.g., the distance between the feeding and the array is sub-wavelength).

Figure 5:
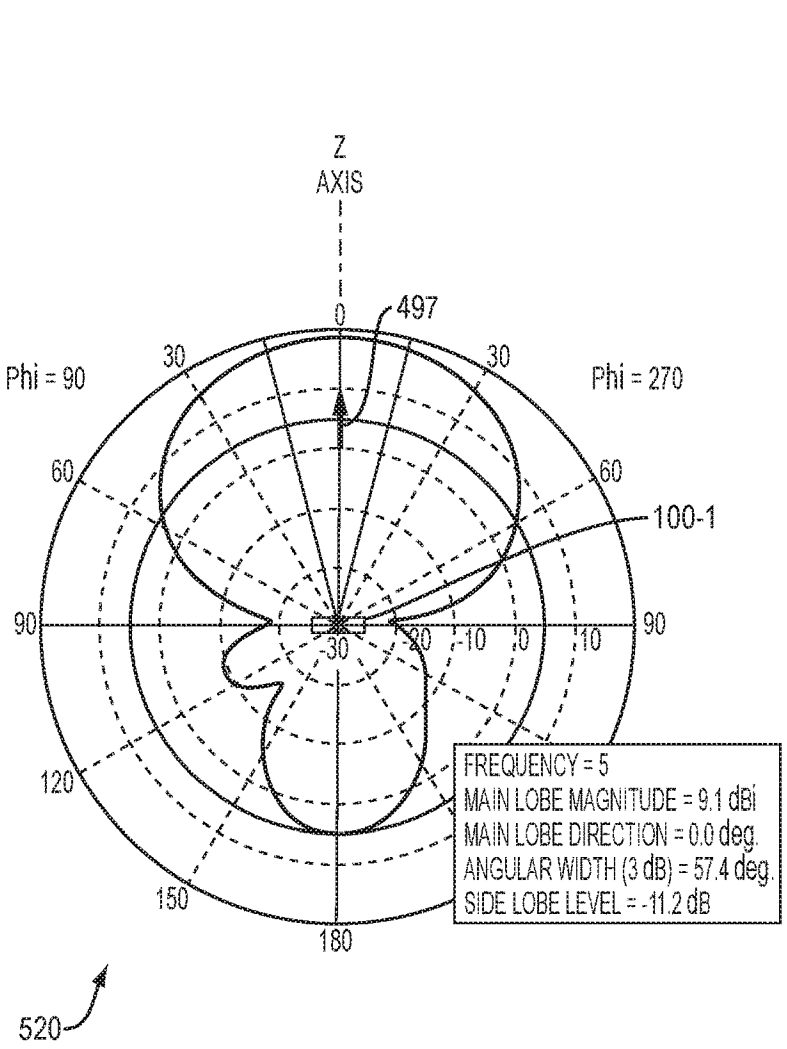
FIG. 5 is an example diagram illustrating a first example radiation pattern of RF energy emitted from a wireless antenna device according to embodiments herein.
Figure 5:
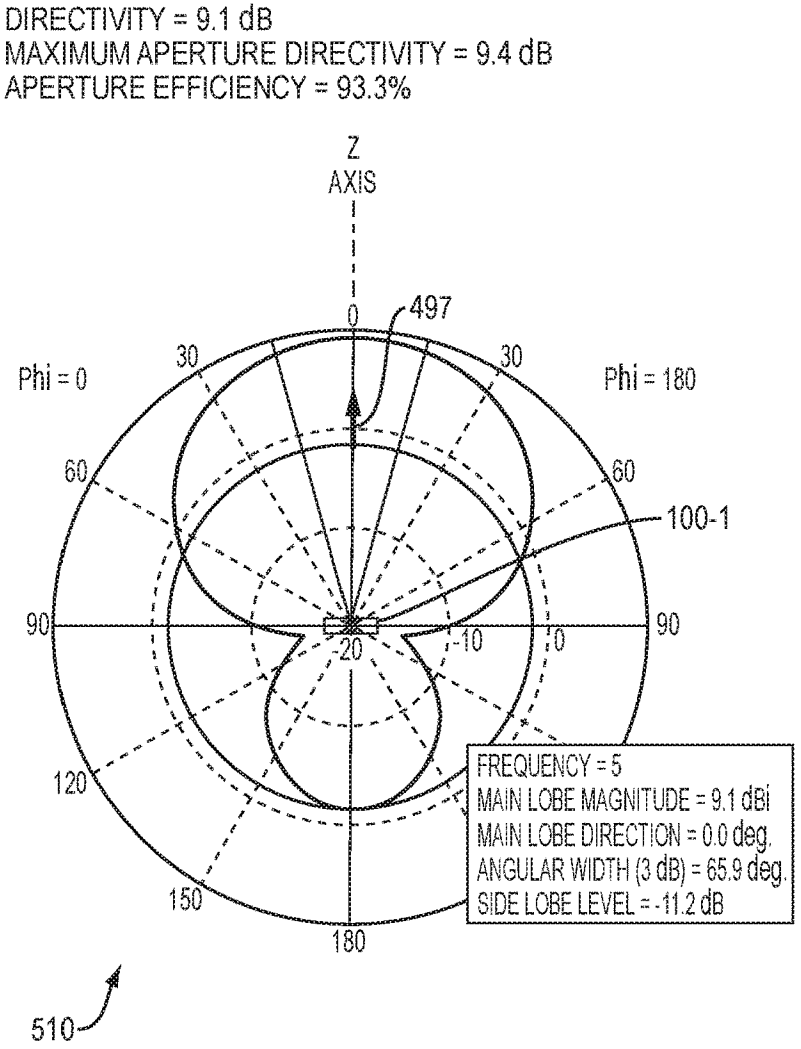

FIG. 5 is an example diagram illustrating a first example radiation pattern from the wireless antenna device according to embodiments herein.

Assume that the antenna device 100-1 (a first example instance of antenna device 100) has the following dimensions:

$T$=0.12*WL (7.4 mm), $L1$=$L2$=0.83*WL (50 mm), and $L3$=$L4$=0.36*WL (21.8 mm).

Assume that the frequency of the signal 405 is 5 GHz.

In such an instance, the antenna device 100-1 produces the radiation pattern 510 and pattern 520 in which directivity is 9.1 dB, maximum aperture directivity is 9.4 dB, and aperture efficiency is 93.3% on the z-axis.

Figure 6:
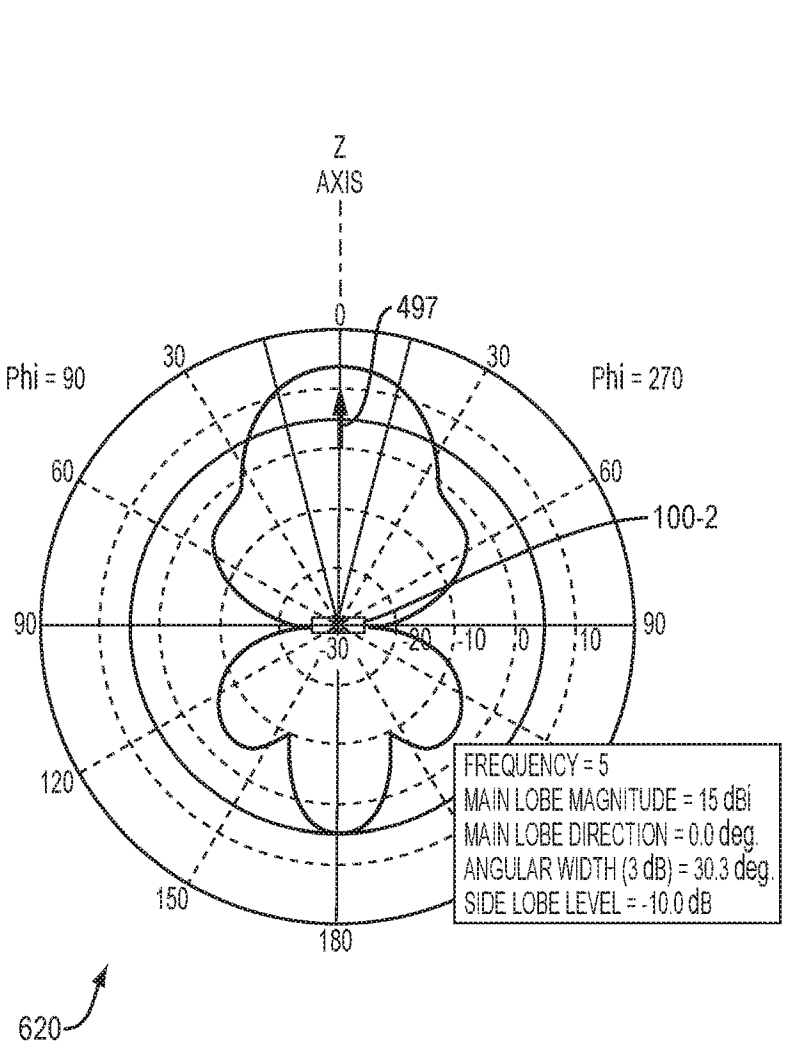
FIG. 6 is an example diagram illustrating a second example radiation pattern of RF energy emitted from a wireless antenna device according to embodiments herein.
Figure 6:
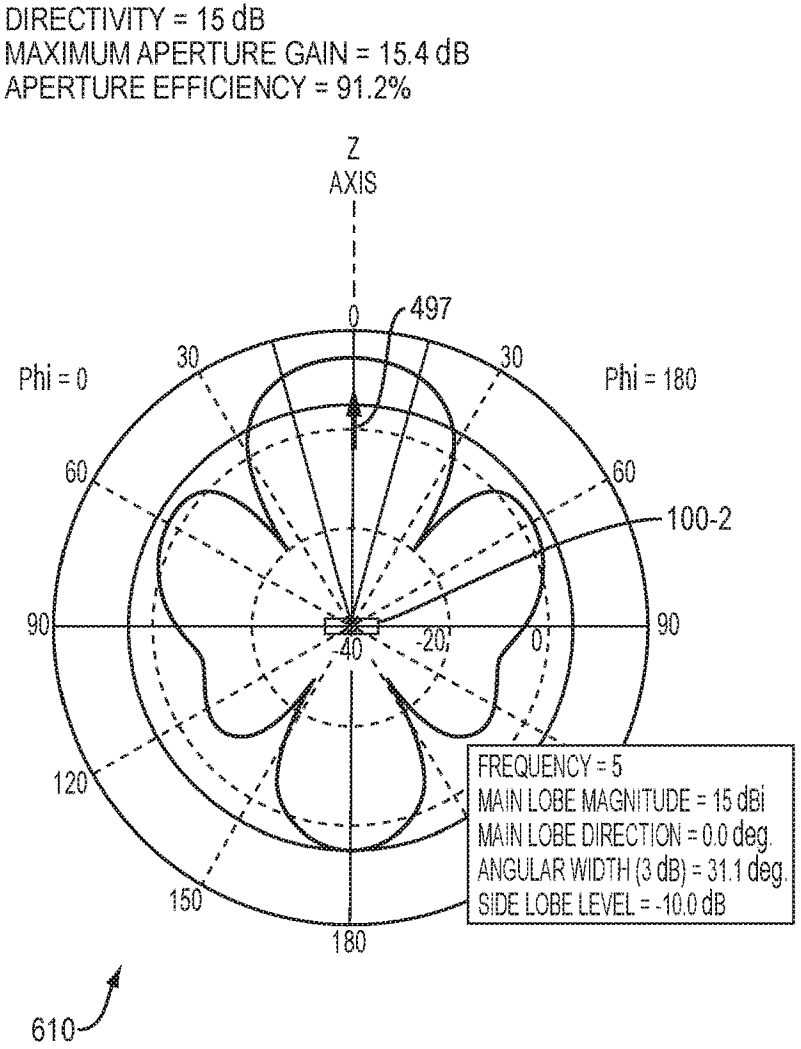

FIG. 6 is an example diagram illustrating a second example radiation pattern from a wireless antenna device according to embodiments herein.

Assume that the antenna device 100-2 (second example instance the antenna device 100) has the following dimensions:

$T$=0.12*WL (7.4 mm), $L1$=$L2$=1.67*WL (100.2 mm), and $L3$=$L4$=0.36*WL (21.8 mm).

Assume that the frequency of the signal 405 is 5 GHz.

In such an instance, the antenna device 100-2 produces the radiation pattern 610 and pattern 620 in which directivity is 15 dB, maximum aperture gain is 15.4 dB, and aperture efficiency is 91.2% on the z-axis.

Figure 7:
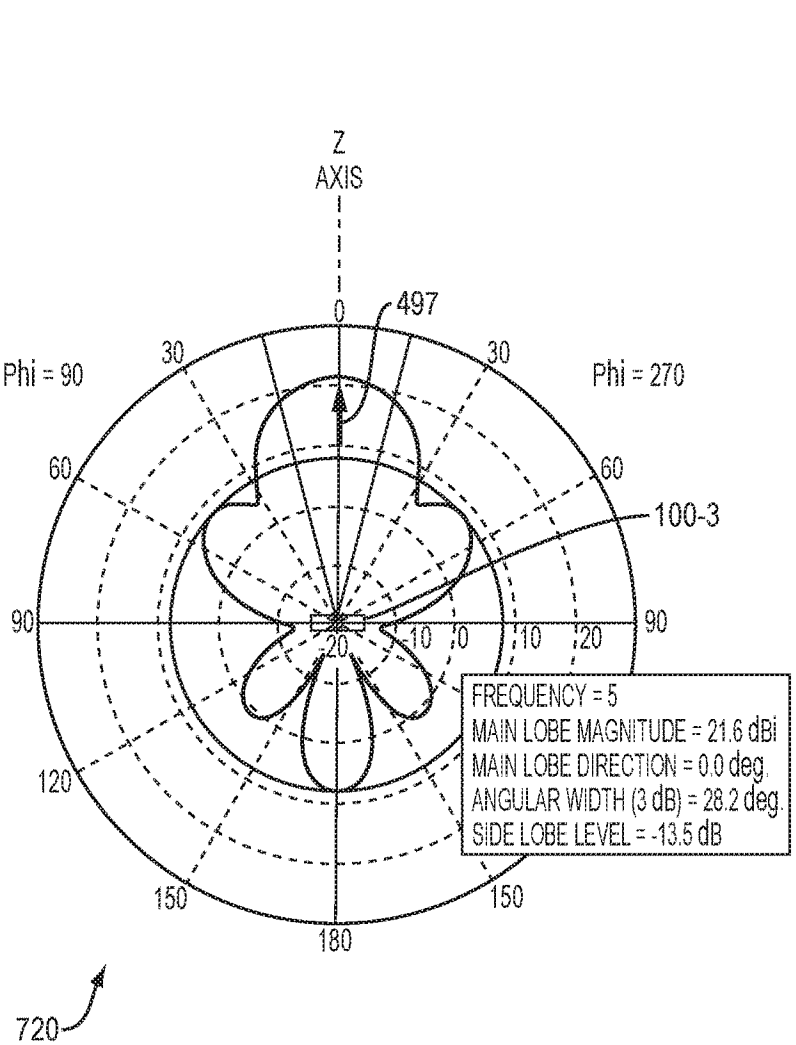
FIG. 7 is an example diagram illustrating a third example radiation pattern of RF energy emitted from a wireless antenna device according to embodiments herein.
Figure 7:
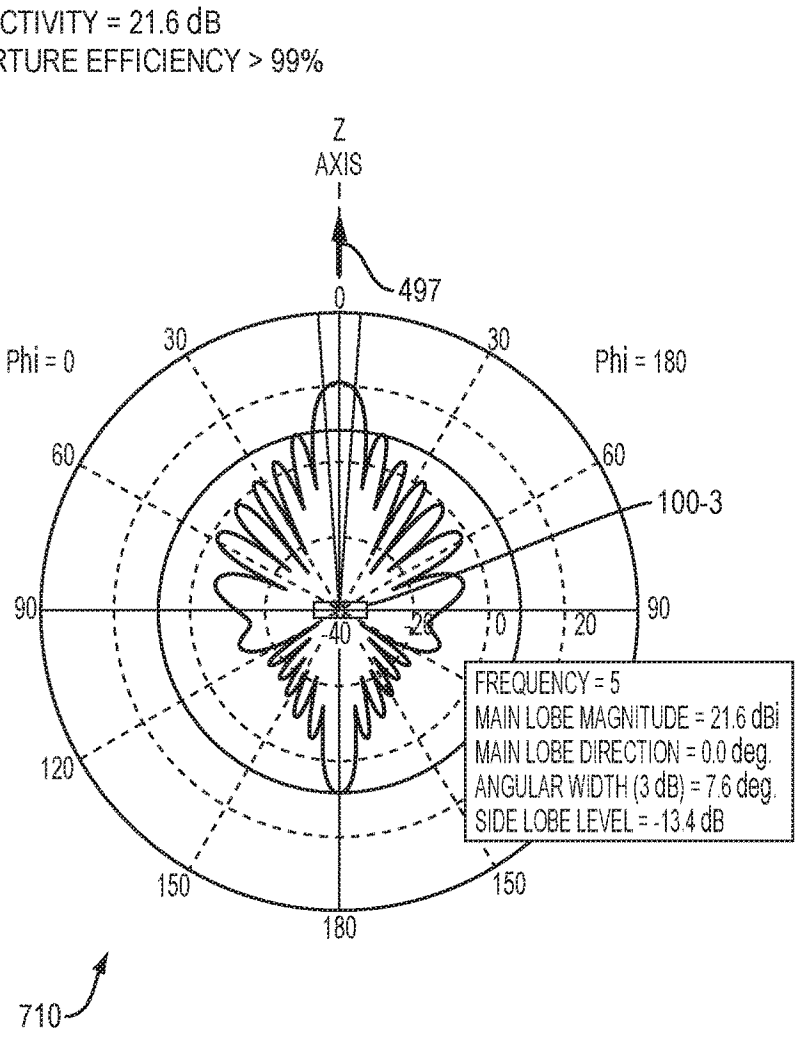

FIG. 7 is an example diagram illustrating a third example radiation pattern from a wireless antenna device according to embodiments herein.

Assume that the antenna device 100-3 has the following dimensions:

$T$=0.12*WL (7.4 mm), $L1$=6.67*WL (400.2 mm), $L2$=1.67*WL (100.2 mm), and $L3$=$L4$=0.36*WL (21.8 mm).

Assume that the frequency of the signal 410 is 5 GHz.

In such an instance, the antenna device 100-3 produces the radiation pattern 710 and pattern 720 in which directivity is 21.6 dB, and aperture efficiency is >99% on the z-axis.

As discussed herein, the proposed antenna device can be constructed by two metal layers separated by a small distance (subwavelength such as a half the wavelength of the driver signal). One metal layer functions as the reflector and one metal layer functions as the radiating element and sub-reflector. Through the combined effect of these two layers, embodiments herein achieve a radiation aperture efficiency of 90% or even higher. Compared to conventional high-gain antennas such as horn and reflector antennas, the proposed antenna device 100 is substantially planar with sub-wavelength overall profile, which makes it easy for fabrication and integration as well as low-cost and light-weight. Other unique features include:

1. The antenna device 100 can be implemented on all available platforms for planar high frequency circuits including printed circuit board (PCB), integrated circuits (CMOS, Bi-CMOS, GaAs, GaN microwave monolithic integrated circuit (MMIC)), low-temperature co-fired ceramic (LTCC), liquid-crystal polymer (LCP).

2. The antenna device 100 can be applied for systems operating at the radio-frequency (RF)/microwave, terahertz (THz), infrared (IR), visible, and even higher.

3. The antenna device 100 can support electromagnetic signals with arbitrary polarizations (e.g. linear, circular, elliptical).

4. The antenna device 100 can be used as the feeding antenna for transmitarray and reflectarray antennas.

Figure 8A:
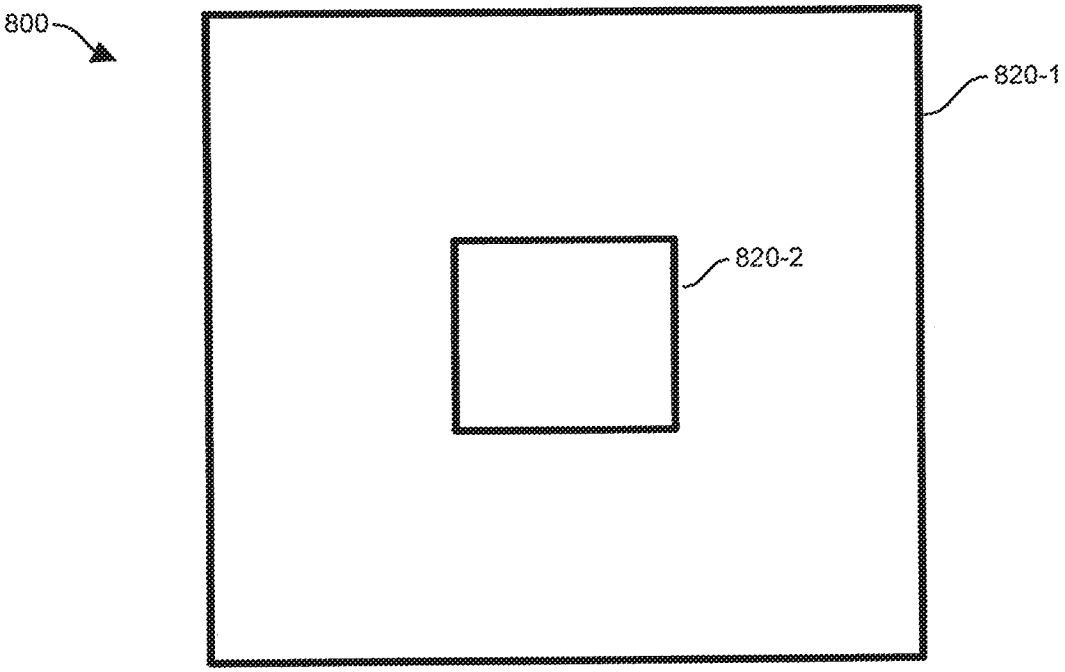
FIG. 8A is an example top view diagram illustrating a first antenna device in a wideband configuration system according to embodiments herein.

FIG. 8A is an example top view diagram illustrating a type of antenna system according to embodiments herein.

As shown in this example embodiment, antenna device 800 includes metal layer 820-2 (such as a patch antenna element) disposed over metal layer 820-1. Additional details of the antenna device 800 are discussed below in FIG. 8B.

Figure 8B:
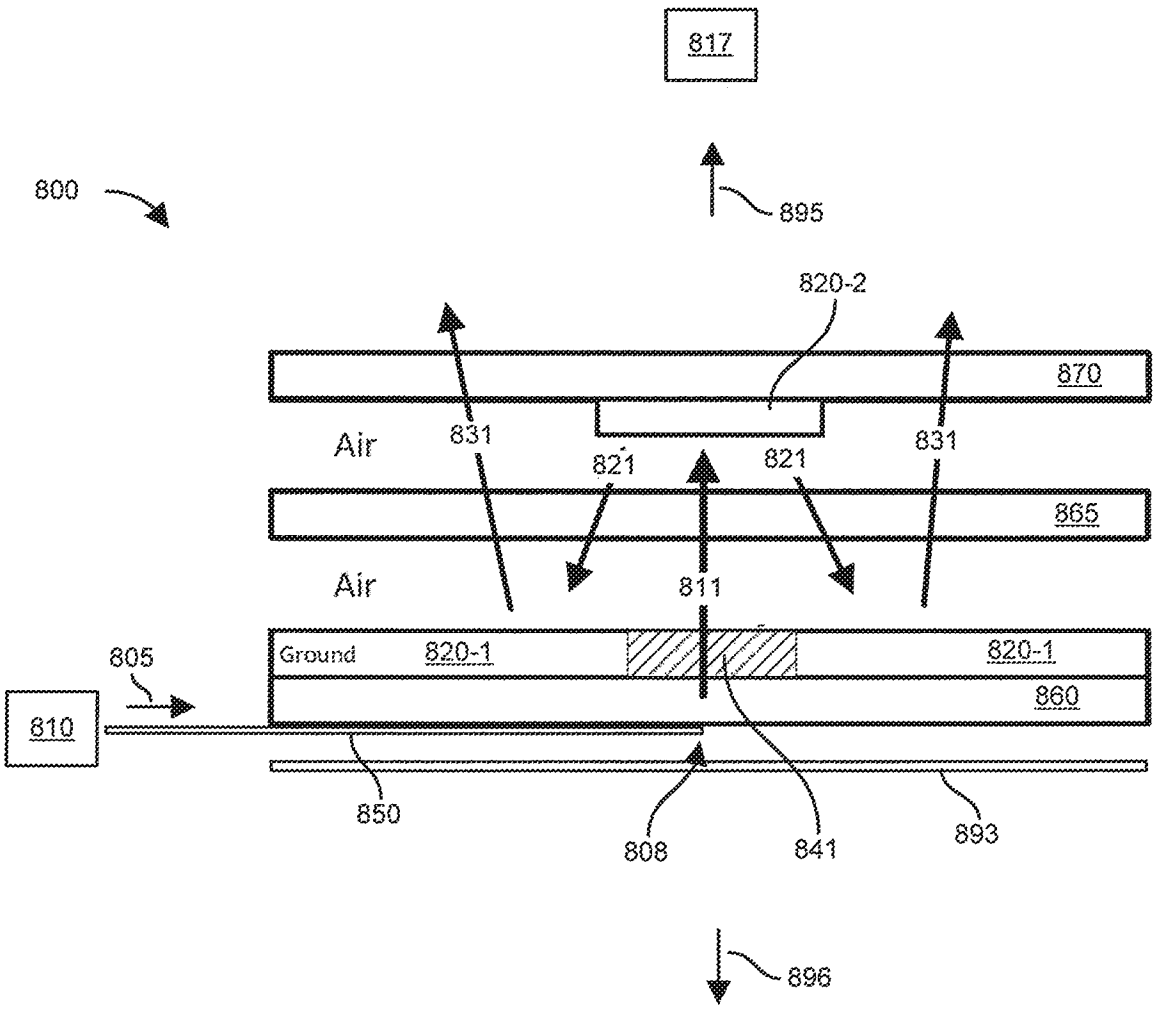
FIG. 8B is an example side view diagram illustrating attributes of a first antenna device in the wideband configuration system according to embodiments herein.

FIG. 8B is an example side view diagram illustrating an antenna system according to embodiments herein.

Note that the antenna device 800 in FIG. 8B operates in a similar manner as the antenna device 100 as previously discussed in FIG. 1.

In one embodiment, the antenna device 800 operates in a first predetermined frequency band such as between 18 and 30 GHz.

More specifically, as shown in FIG. 8B, antenna device 800 includes a stacking and spacing of substrate 860, substrate 865 (optional), and substrate 870. In one embodiment, the substrates are spaced apart via air layers, although any suitable material can be used to separate substrates.

Further in this example embodiment, metal layer 820-1 is disposed on substrate 860. Metal layer 820-2 (patch antenna element) is disposed on substrate 870.

Metal layer 820-1 includes opening 841 in which to emit an RF signal 805 conveyed from resource 810. More specifically, during operation, the resource 810 (such as a driver) produces signal 805 (such as a RF signal) conveyed over feed line 850 to the opening 841. The location 808 of the feed line 805 acts as a radiation source from which RF energy 811 (from signal 805) is wirelessly transmitted through substrate 860 (such as a dielectric material) and opening 841 of metal layer 820-1 (disposed on substrate 860).

Metal layer 820-2 receives RF energy 811 and reflects the received RF energy 811 as RF energy 821 back through substrate 865 (when present) to metal layer 820-1 as shown. Metal layer 820-1 reflects the RF energy 821 as RF energy 831 approximately in direction 895 from antenna device 800 to a remote communication device.

As previously discussed, note again that the antenna device 800 can include a respective reflector 893 (such as metal layer) to limit an amount of RF energy that is transmitted in direction 896 such as to a remote resource such as communication device 817.

Figure 9B:
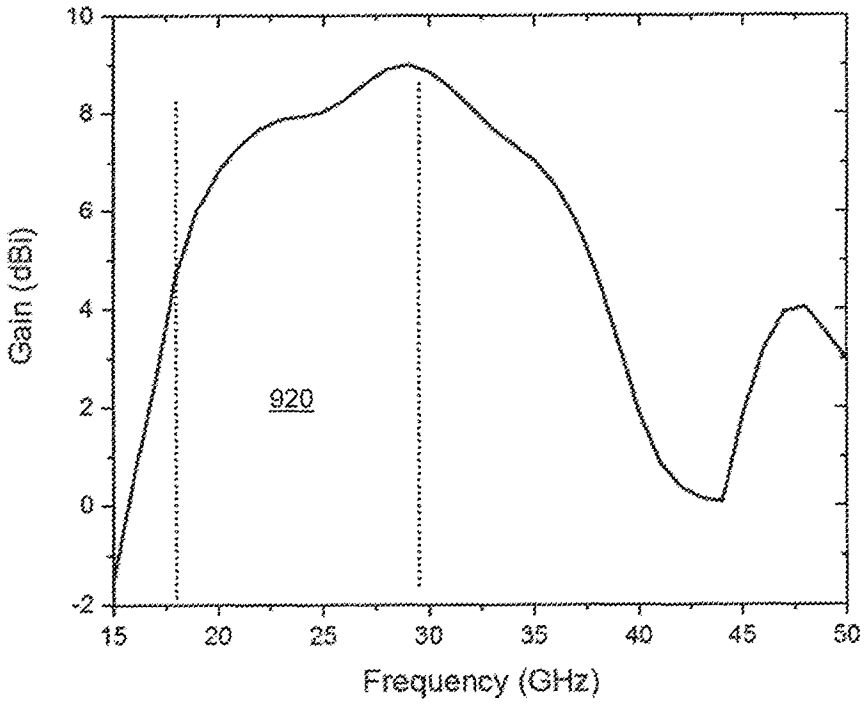
FIG. 9B is an example diagram illustrating gain of the first antenna device across multiple frequencies according to embodiments herein.
Figure 9A:
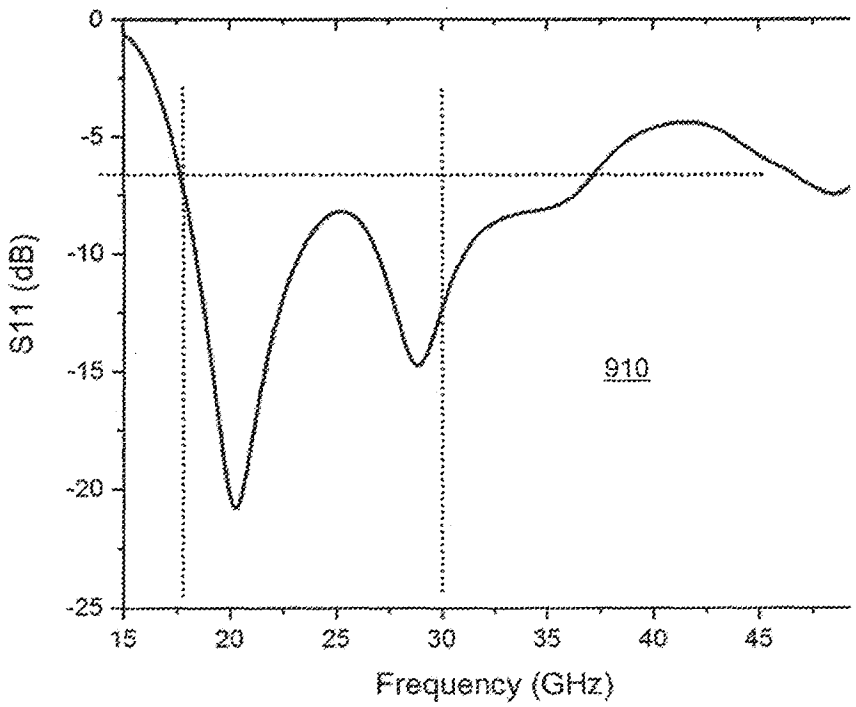
FIG. 9A is an example diagram illustrating return loss power distribution from the first antenna device across multiple frequencies according to embodiments herein.

FIG. 9A is an example diagram illustrating return loss from an antenna device across multiple frequencies according to embodiments herein.

Graph 910 illustrates the return loss of the antenna device 800 (i.e. returned power to the source of a respective input signal for different carrier frequencies transmitted from antenna device 800). In general, as indicated by graph 910, the antenna device 800 is suitable to transmit RF energy at carrier frequencies between 18 and 30 GHz.

FIG. 9B is an example diagram illustrating gain of an antenna device across multiple frequencies according to embodiments herein.

In this example embodiment, graph 920 illustrates that the gain provided by antenna device 800 is above a threshold value for different signals from antenna device 800 transmitted at carrier frequencies 18-30 GHz. Thus, as indicated by graph 920, the antenna device 800 is suitable to transmit RF energy at carrier frequencies between 18 and 30 GHz.

Figure 10:
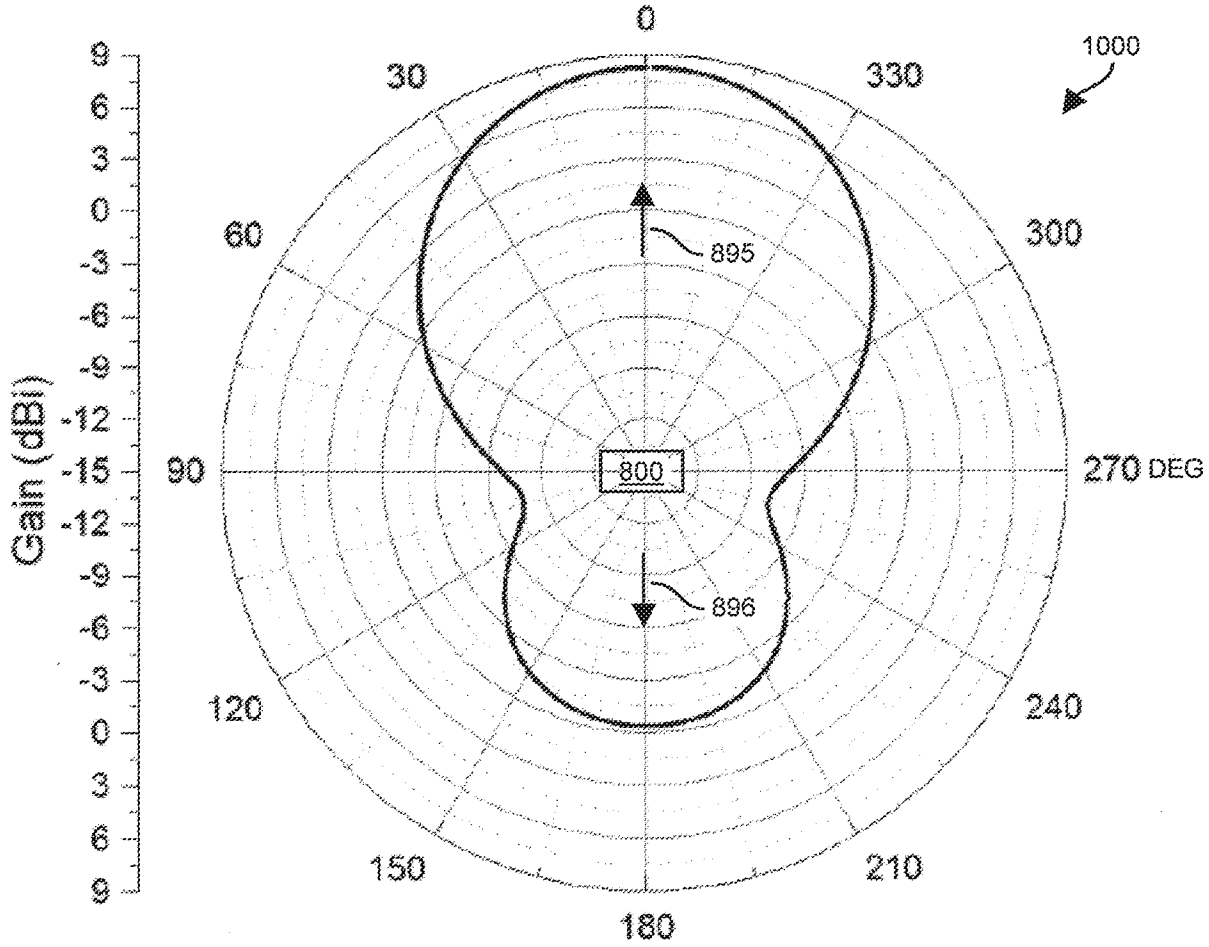
FIG. 10 is an example diagram illustrating an example radiation pattern of the first antenna device according to embodiments herein.

FIG. 10 is an example diagram illustrating an example radiation pattern of an antenna device according to embodiments herein.

Graph 1000 indicates gain associated with antenna device 800 (such as without reflector 893) at different angular orientations with respect to the antenna device 800. As shown, antenna device 800 transmits RF signals mainly in direction 895. As previously discussed, antenna device 800 can include reflector 893 to reduce an amount of wireless RF transmitted in direction 896.

Figure 11A:
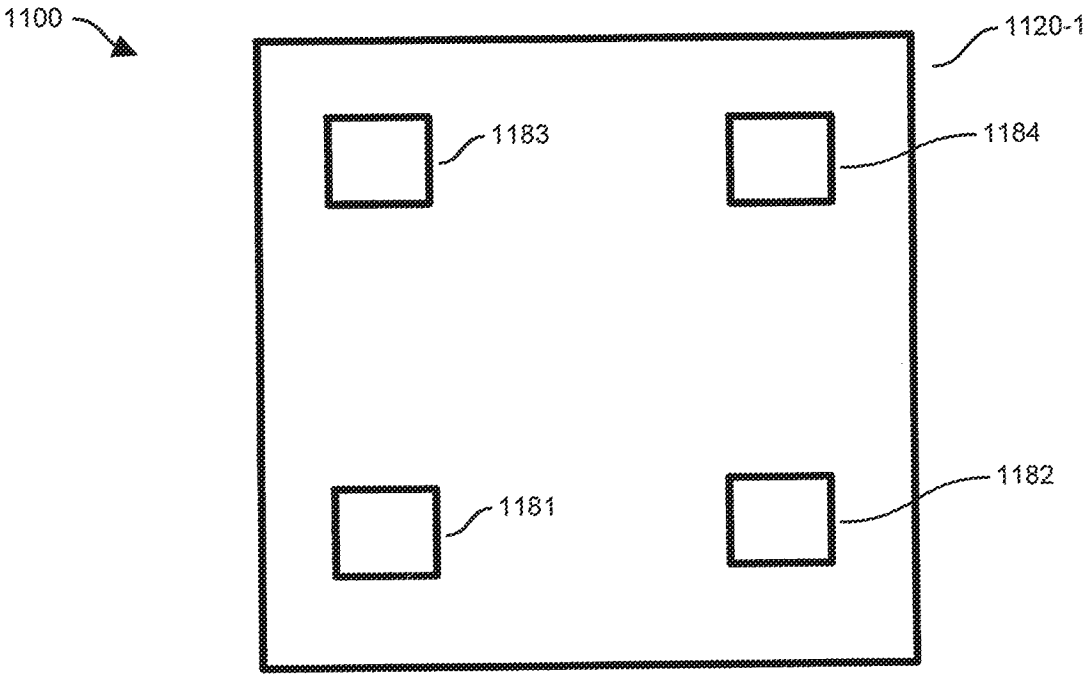
FIG. 11A is an example top view diagram illustrating a second antenna device in the wideband configuration system (including multiple antenna elements) according to embodiments herein.

FIG. 11A is an example top view diagram illustrating a second device according to embodiments herein.

As shown, antenna device 1100 includes multiple metal layers including patch antenna elements associated with antenna element 1181, 1182, 1183, and 1184 disposed over metal layer 1120-1. Thus, antenna device 1100 can be configured to include multiple patch antenna elements to transmit and receive RF energy.

Figure 11B:
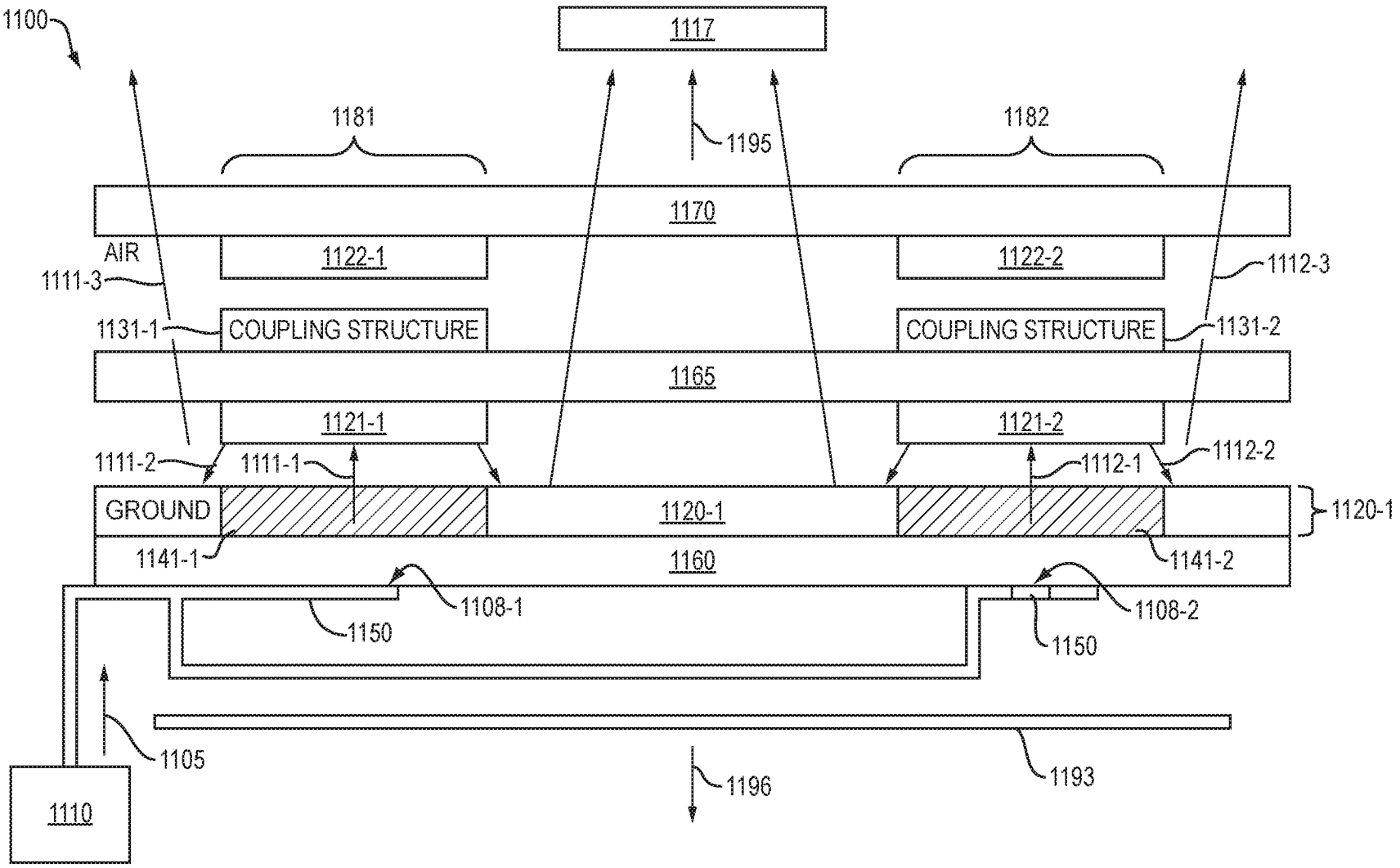
FIG. 11B is an example side view diagram illustrating attributes of the second antenna system according to embodiments herein.

FIG. 11B is an example side view diagram illustrating an antenna system according to embodiments herein.

In this example embodiment, each of the antenna elements 1181, 1182, etc., in the antenna device 1100 in FIG. 11B operates in a similar manner as the antenna device 100 as previously discussed in FIG. 1. However, a combination of or individual antenna elements 1181, 1182, etc., of the antenna device 1100 operate(s) in a second predetermined frequency band such as between 30 and 50 GHz.

More specifically, as shown in FIG. 11B, antenna device 1100 includes a stacking of substrate 1160, substrate 1165, and substrate 1170. In one embodiment, the substrates are spaced apart via air layers or dielectric material.

Metal layer 1120-1 of antenna device 1100 is disposed on substrate 1160. In this example embodiment, metal layer 1120-1 includes multiple openings 1141-1, 1141-2, etc., associated with each of the antenna elements 1181, 1182, etc.

As further discussed below, opening 1141-1 in metal layer 1120-1 provides a location (with respect to feed line 1150)

from which to transmit/receive RF energy associated with antenna element 1181 (such as a combination of patch antenna element 1121-1, coupling structure 1131-1, and patch antenna element 1122-1); opening 1141-2 provides a location (with respect to feed line 1150) from which to transmit/receive RF energy associated with antenna element 1182 (such as a combination of patch antenna element 1121-2, coupling structure 1131-2, and patch antenna element 1122-2); and so on.

During operation, the source 1110 (such as a driver) produces signal 1105 (such as an RF signal) conveyed over feed line 1150 to the openings 1141-1, 1141-2, etc.

The location 1108-1 of the feed line 1105 acts as a radiation source from which RF energy 1111-1 (from signal 1105) is transmitted through opening 1141-1 to antenna element 1181. A combination of patch antenna element 1121-1, coupling structure 1131-1, and patch antenna element 1122-1 of antenna element 1181 reflects the received RF energy 1111-1 as RF energy 1111-2 to the metal layer 1120-1. Metal layer 1120-1 reflects the received RF energy 1111-2 and reflects it approximately in direction 1195 as RF energy 1111-3 from antenna device 1100.

Additionally, the location 1108-2 of the feed line 1105 acts as a radiation source from which RF energy 1112-1 (generated from signal 1105) through opening 1141-2 is transmitted through to antenna element 1182. A combination of patch antenna element 1121-2, coupling structure 1131-2, and patch antenna element 1122-2 associated with antenna element 1182 reflects the received RF energy 1112-1 as RF energy 1112-2 to the metal layer 1120-1. Metal layer 1120-1 reflects the received RF energy 1112-2 and reflects it approximately in direction 1195 as RF energy 1112-3 from antenna device 1100.

Each of the four antenna elements 1181, 1182, 1183, and 1184 in substrate 1165 and 1170 operate in a similar manner to produce an overall wireless signal transmitted from antenna device 1100.

In a similar manner as previously discussed, the antenna device 1100 can include a respective reflector 1193 (such as metal layer) to limit or reduce an amount of RF energy that is transmitted in direction 1196 from antenna device 1100.

Figure 12B:
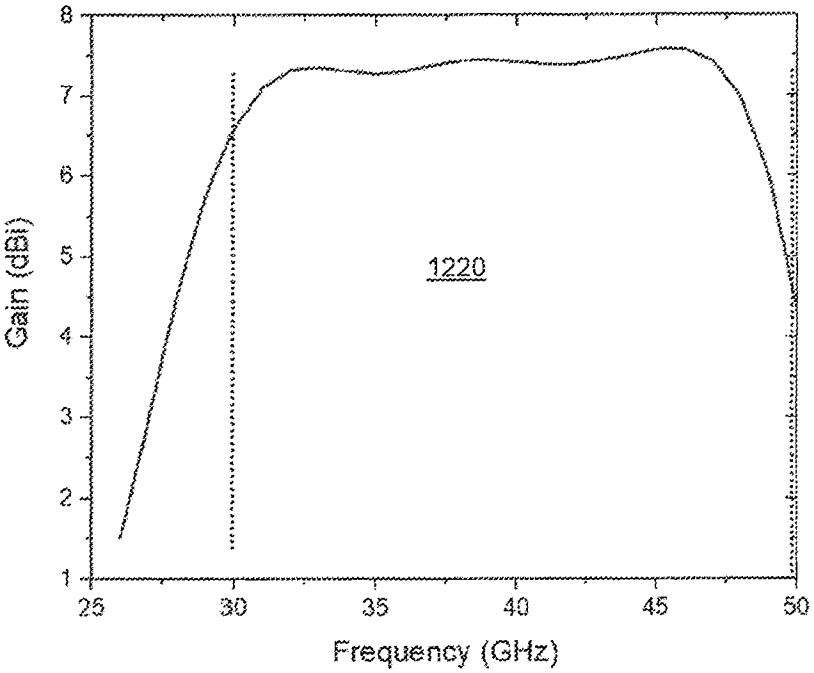
FIG. 12B is an example diagram illustrating gain of an antenna system (of FIG. 11B) across multiple frequencies according to embodiments herein.
Figure 12A:
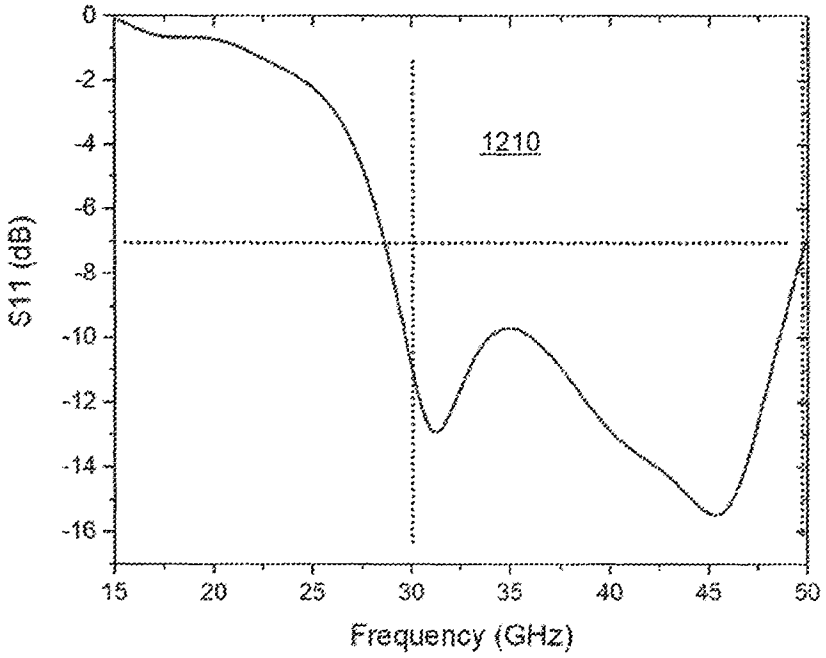
FIG. 12A is an example diagram illustrating return loss from an antenna system (of FIG. 11B) across multiple frequencies according to embodiments herein.

FIG. 12A is an example diagram illustrating power distribution from an antenna device across multiple frequencies according to embodiments herein.

More specifically, graph 1210 of FIG. 12A illustrates transmission power of a respective input signal for different carrier frequencies transmitted from antenna elements of antenna device 1100. In general, as shown, the antenna device 1100 is suitable to transmit RF energy at carrier frequencies in a band between 30 and 50 GHz.

FIG. 12B is an example diagram illustrating gain of an antenna device across multiple frequencies according to embodiments herein.

Graph 1220 illustrates that the gain provided by antenna device 1100 is above a threshold value for different carrier frequencies 30-50 GHz transmitted from antenna device 1100.

Figure 13:
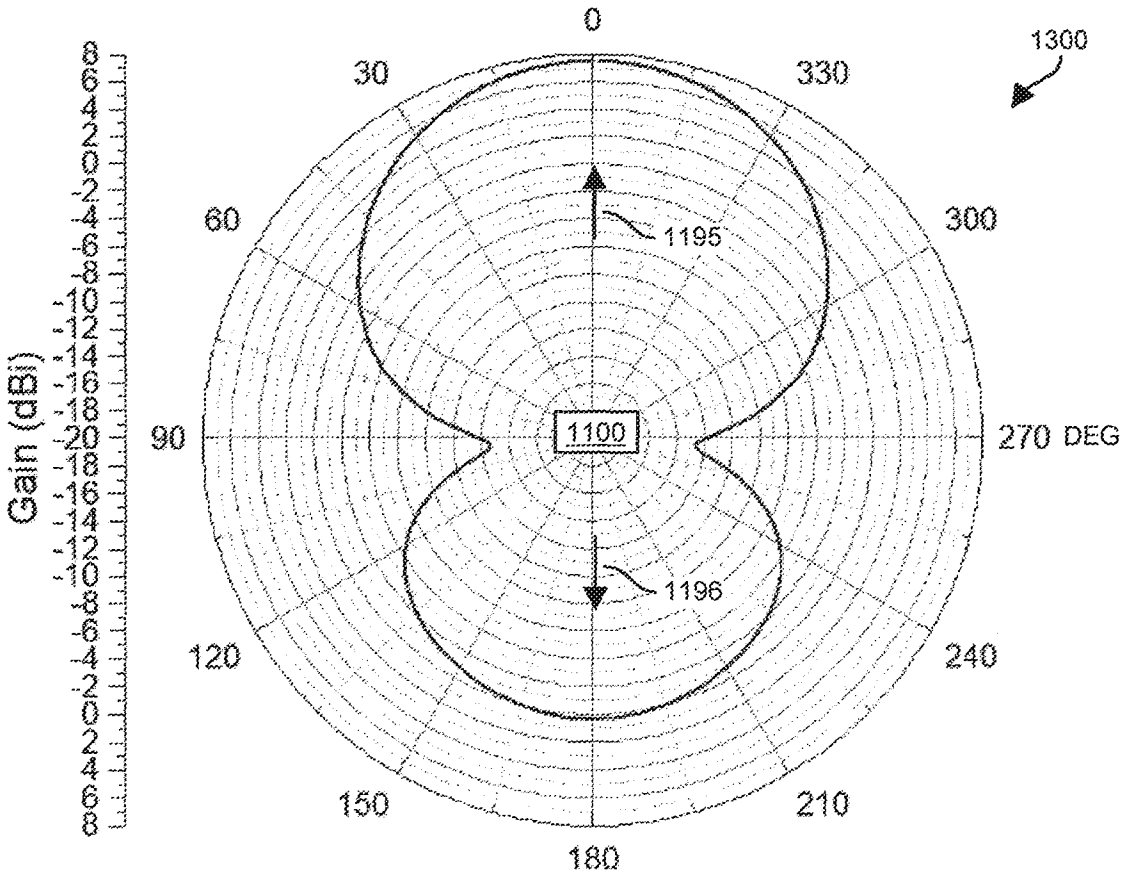
FIG. 13 is an example diagram illustrating an example radiation pattern of one of the element in an antenna system (of FIG. 11B) according to embodiments herein.

FIG. 13 is an example diagram illustrating an example radiation pattern of an antenna device according to embodiments herein.

Graph 1300 indicates gain associated with antenna device 1100 at different angular orientations with respect to the antenna device 1100. As shown, antenna device 1100 transmits RF signals mainly in direction 1195.

Figure 14A:
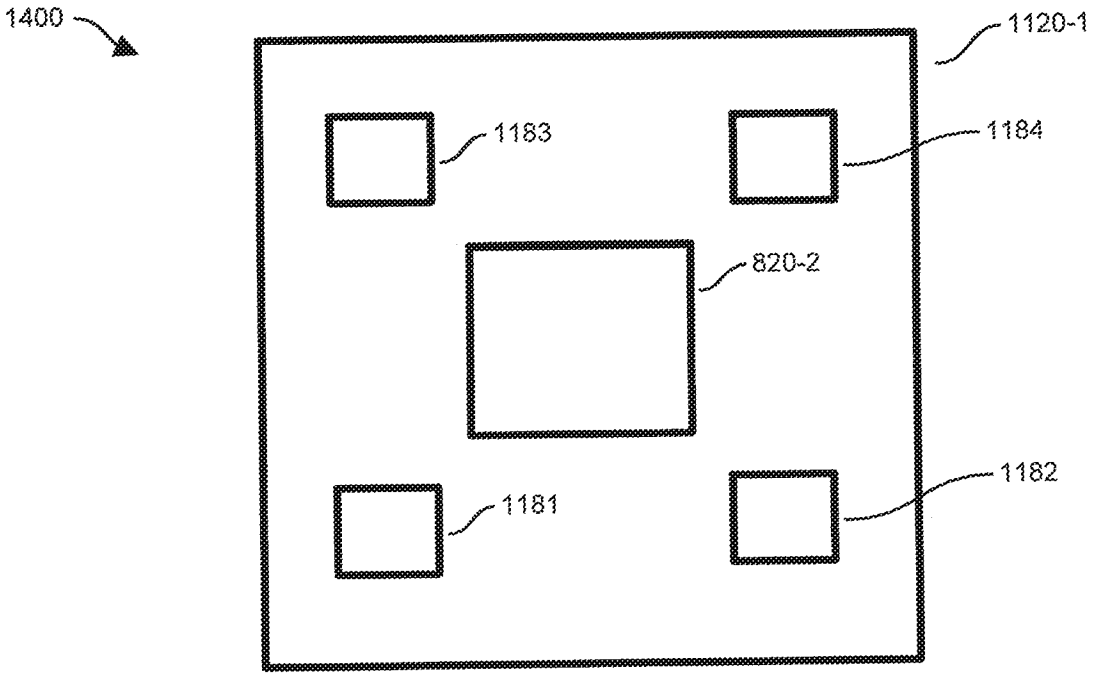
FIG. 14A is an example top view diagram illustrating a third antenna system (including multiple antenna elements) according to embodiments herein.

FIG. 14A is an example top view diagram illustrating attributes of a multi-band antenna system according to embodiments herein.

In this example embodiment, the antenna device 1400 includes a combination of a antenna element (such as metal layer 820-2) associated with antenna device 800 (of FIG. 8B) and antenna elements 1181, 1182, 1183, and 1184 associated with antenna device 1100 (of FIG. 11) to operate in multiple different bands.

For example, the metal layer 820-2 (such as a patch antenna element) supports wireless emissions of data in a first carrier frequency band (such as between 18-30 GHz); in a manner as previously discussed, the combination of antenna elements 1181, 1182, 1183, and 1184 support wireless emissions of data in a second carrier frequency band (such as between 30-50 GHz).

Figure 14B:
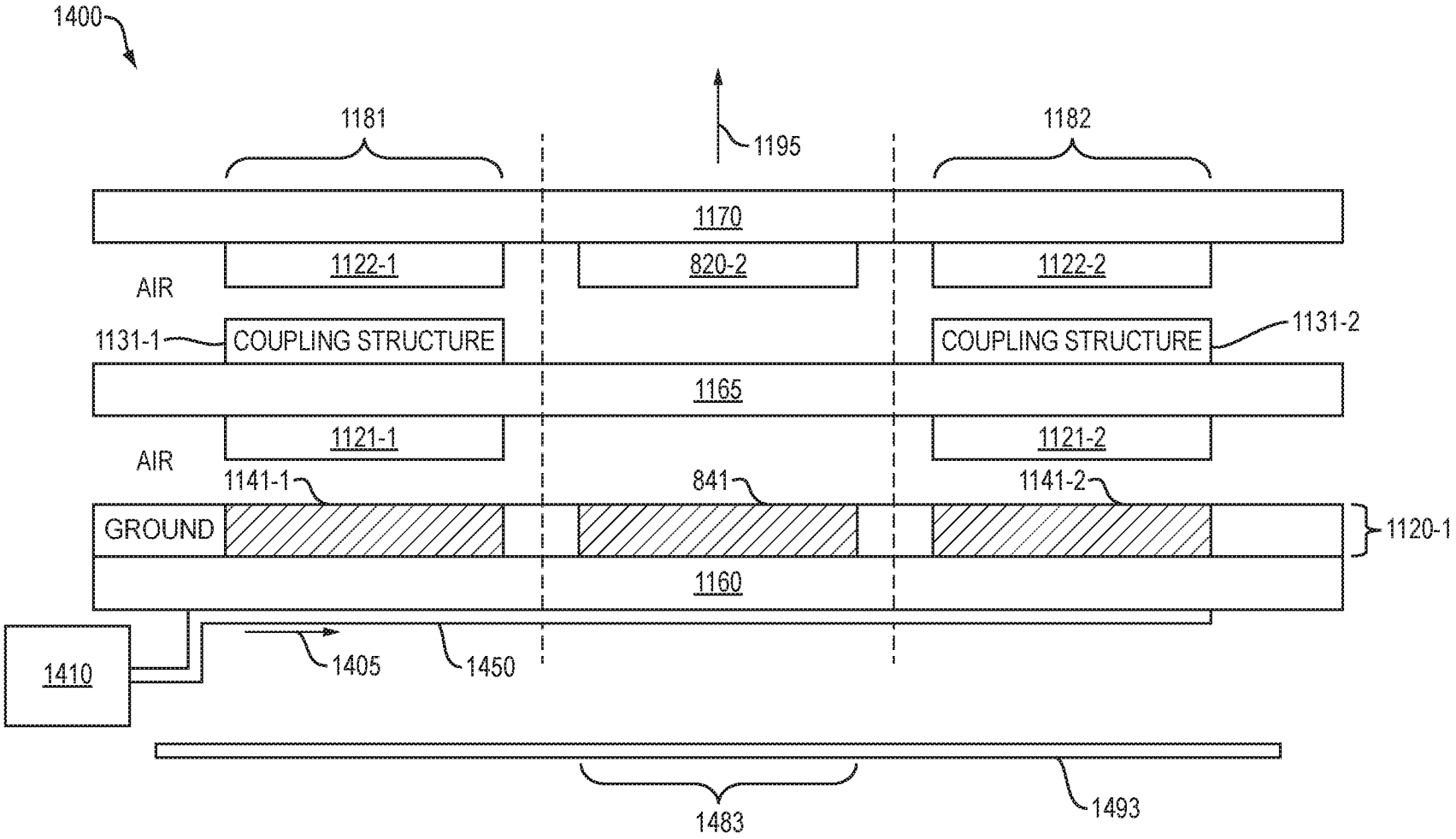
FIG. 14B is an example side view diagram illustrating attributes of the third antenna system according to embodiments herein.

FIG. 14B is an example side view diagram illustrating attributes of a multi-band antenna system according to embodiments herein.

As shown, the antenna device 1400 includes a combination of antenna device 800 and antenna device 1100. In this example embodiment, the metal layer 820-2 (such as a patch antenna element) associated with antenna element 1483 supports wireless emissions of data in a first carrier frequency band (such as between 18-30 GHz); the combination of antenna elements 1181, 1182, etc., support wireless emissions of data in a second carrier frequency band (such as between 30-50 GHz).

Accordingly, antenna device 1400 operates in a dual band or broadband mode.

Figure 15:
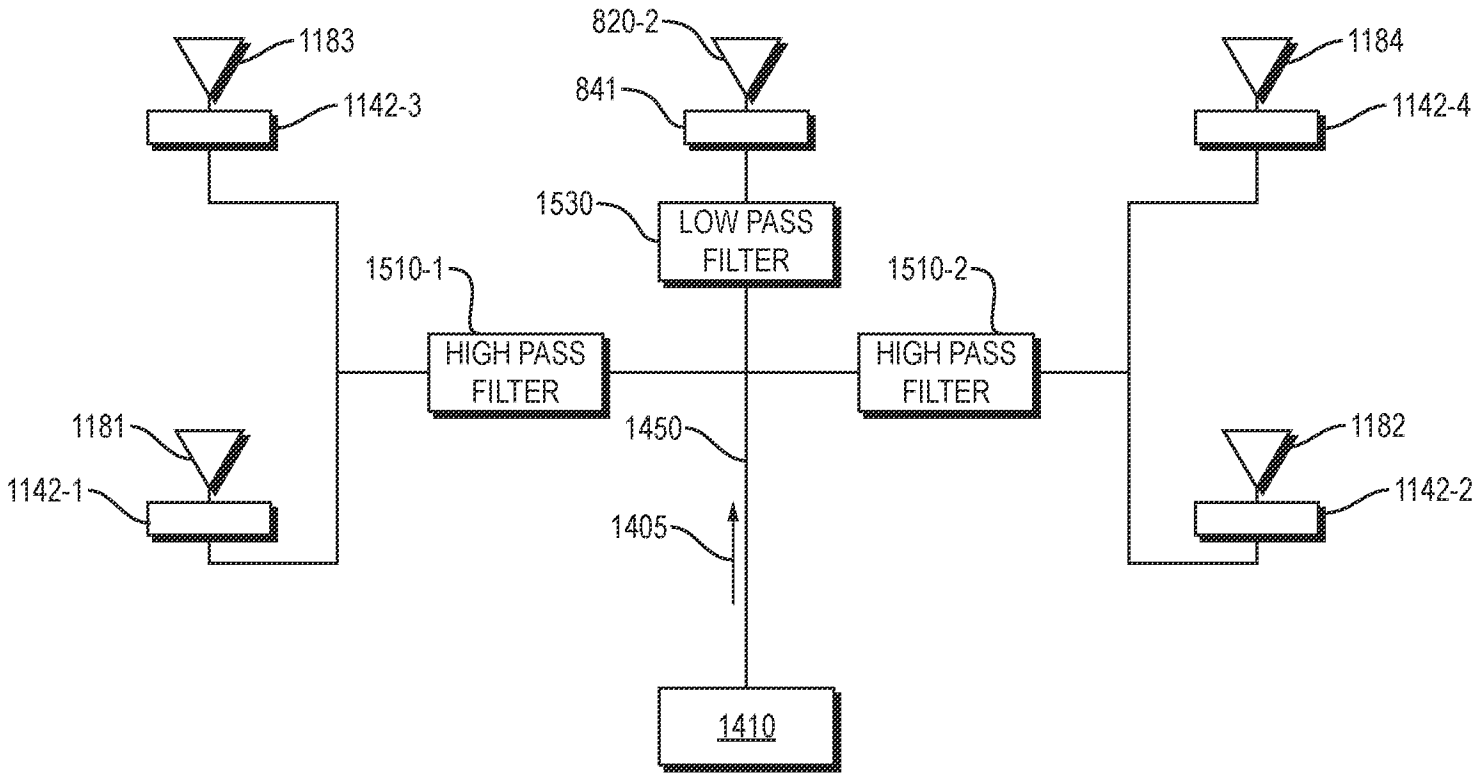
FIG. 15 is an example diagram illustrating attributes of the feeding network of the multi-band antenna system (third system, FIG. 14B) according to embodiments herein.

FIG. 15 is an example diagram illustrating attributes of the multi-band antenna system according to embodiments herein.

In one embodiment, the feedline 1450 (or feed network associated with the antenna device 1400) disposed on bottom of substrate 1160 includes low pass filter 1530, high pass filter 1510-1, and high pass filter 1510-2.

In this example embodiment, the source (such as a transmitter and/or receiver) inputs RF signal 1405 to feed line 1450.

Via respective filtering applied to the RF signal 1405, the low pass filter 1530 conveys a first band (such as between 18-30 GHz) of frequencies of signal 1405 through the opening 841 (in metal layer 1120-1) to the metal layer 820-2.

Via respective filtering applied to the RF signal 1405, the high pass filter 1510-1 conveys a second band of frequencies (such as between 30-50 GHz) of signal 1405 through the openings 1142-1 and 1142-3 in metal layer 1120-1 to the respective antenna element 1181 (combination of patch antenna element 1121-1, coupling structure 1131-1, and patch antenna element 1122-1) and antenna element 1183 of antenna device 1400.

Via respective filtering applied to the RF signal 1405, the high pass filter 1510-2 conveys a second band of frequencies (such as between 30-50 GHz) of signal 1405 through the openings 1142-2 and 1142-4 in the metal layer 1120-1 to the respective antenna elements 1182 (combination of patch antenna element 1121-2, coupling structure 1131-2, and patch antenna element 1122-2) and antenna element 1184.

Figure 16:
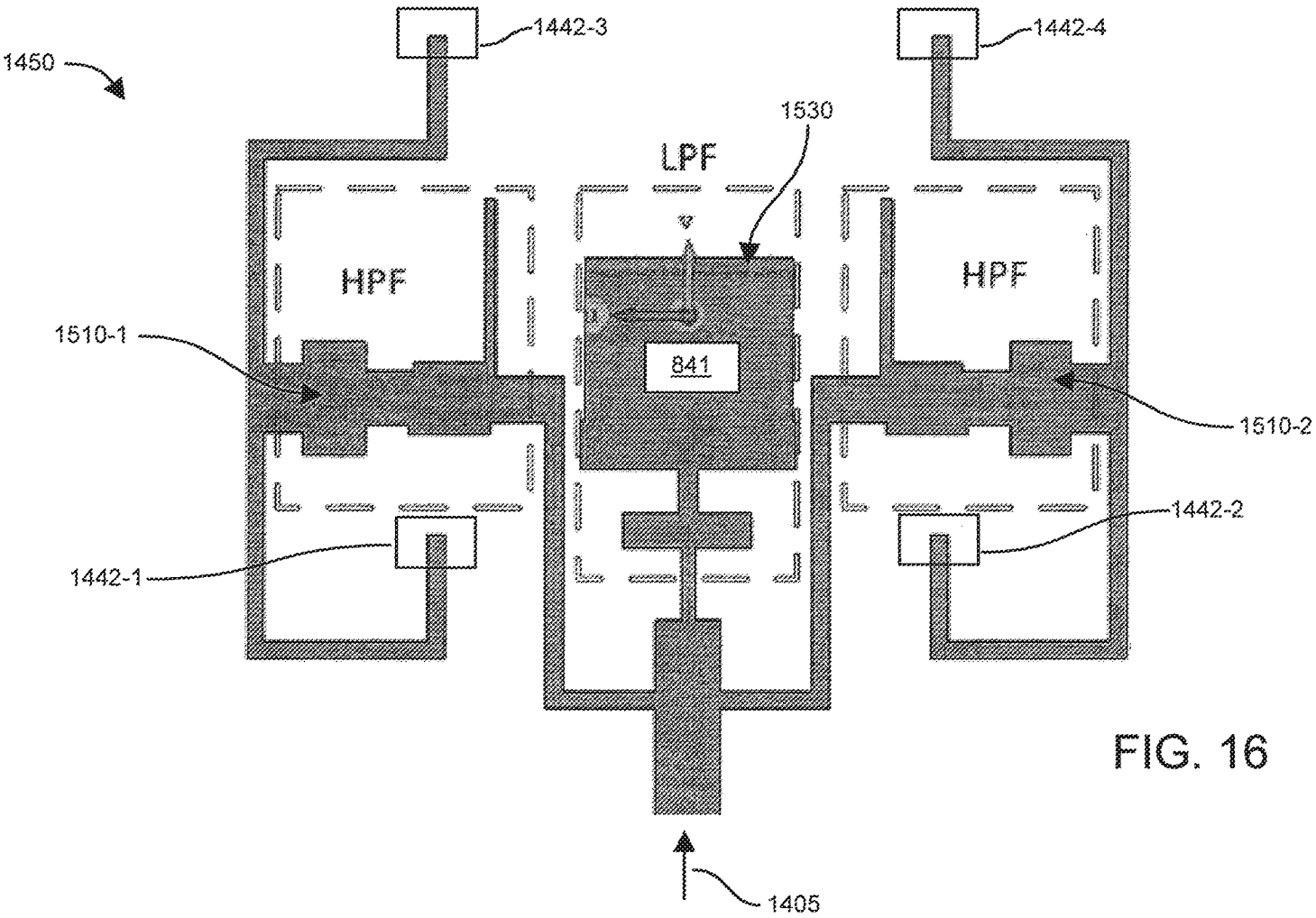
FIG. 16 is an example diagram illustrating a fabrication layer to implement the feeding network of the multi-band antenna system (third system, FIG. 14B) according to embodiments herein.

FIG. 16 is an example diagram illustrating a top view of a fabrication layer (or feeding network) to implement the multi-band antenna system according to embodiments herein.

In this example embodiment, the feed line 1450 (and corresponding feed network) disposed on bottom of substrate 1160 of antenna device 1400 provides connectivity of resource 1410 (such as transmitter and/or receiver) to respective openings 1141-1, 1141-2, 841, etc., disposed in metal layer 1120-1. In the example embodiment shown, feed line 1150 and corresponding feeding network (associated with antenna device 1400) is a metal layer disposed on the bottom surface of substrate 1160.

The different shapes associated with the high pass filters 1510-1 and 1510-2 as well as low pass filter 1530 provide filtering of signal 1405 such that respective openings receive the appropriate input RF signal. In a manner as previously discussed, via transmission of the lower frequencies of the input signal 1405 through low pass filter 1530 to the opening 841, the antenna element 1483 (such as patch antenna element 820-2) supports conveyance of wireless data in direction 1495 from antenna device 1400.

Via transmission of the higher frequencies of the input signal 1405 through high pass filter 1510-1 to the openings 1442-1, 1442-3, etc., the corresponding antenna elements 1481 and 1483 support conveyance of wireless data in direction 1495 from antenna device 1400.

Via transmission of the higher frequencies of the input signal 1405 through high pass filter 1510-2 to the openings 1442-2 and 1442-4, the corresponding antenna elements 1482 and 1484 support conveyance of wireless data in direction 1495 from antenna device 1400.

Figure 17:
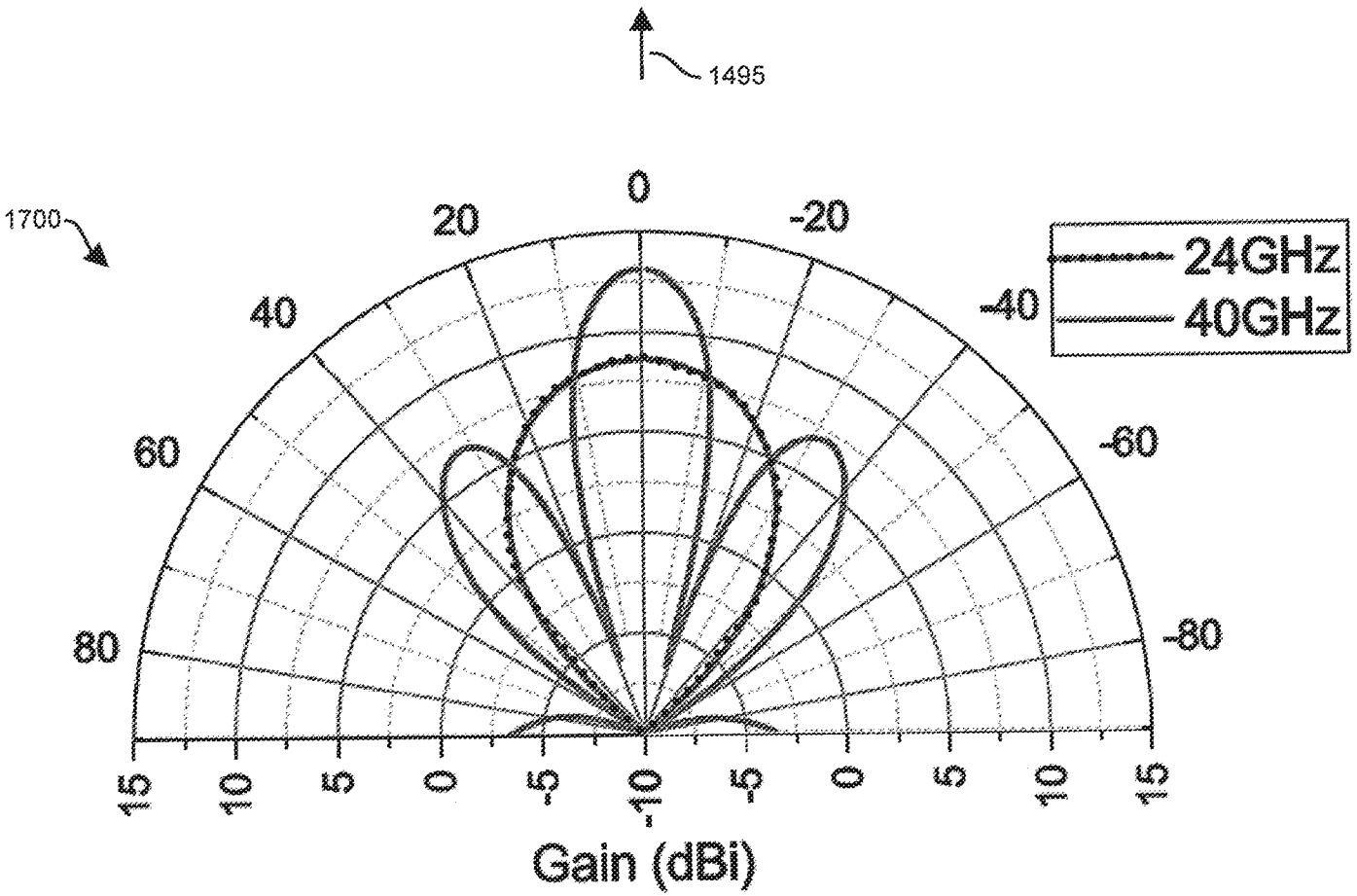
FIG. 17 is an example diagram illustrating an example radiation pattern of the multiple-band antenna system (third system, FIG. 14A) according to embodiments herein.

FIG. 17 is an example diagram illustrating an example radiation pattern of the multiple-band antenna device according to embodiments herein.

As shown in graph 1700, the metal layer 820-2 (patch antenna element) supports wireless emissions at 24 GHz (such as for a first predetermined band between 18-30 GHz).

The antenna element 1181 (combination of patch antenna element 1121-1, coupling structure 1131-1, and patch antenna element 1122-1), antenna element 1182 (combination of patch antenna element 1121-2, coupling structure 1131-2, and patch antenna element 1122-2), antenna element 1483, and antenna element 1484 associated with antenna device 1400 support wireless emissions at 40 GHz (such as for a second predetermined band between 30-50 GHz).

The graph 1700 illustrates that both antenna systems (such as patch antenna element 820-1 and antenna elements 1181, 1182, 1183, and 1184) provide high gain in the direction 1495 from antenna device 1400. In a similar manner as previously discussed, the antenna device 1400 can include a reflector 1493 to reduce RF energy transmitted in direction 1496.

Figure 18:
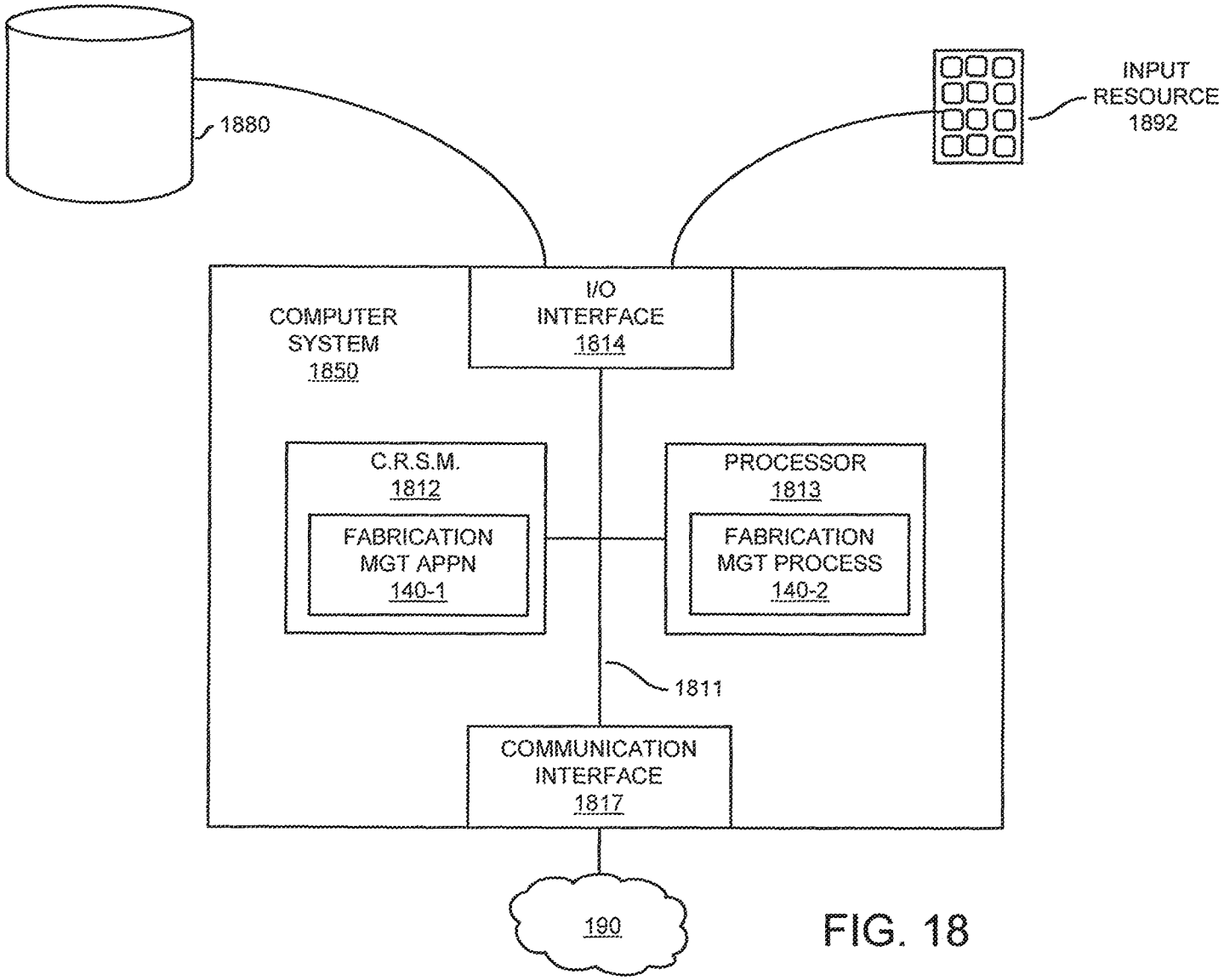
FIG. 18 is a diagram illustrating example computer architecture to execute operations according to embodiments herein.

FIG. 18 is an example block diagram of a computer system for implementing any of the operations as discussed herein according to embodiments herein.

Any of the resources as discussed herein can be configured to include a processor and executable instructions to carry out the different operations as discussed herein.

As shown, computer system 1850 (such as a respective server resource) of the present example can include an interconnect 1811 that couples computer readable storage media 1812 such as a non-transitory type of media (i.e., any type of hardware storage medium) in which digital information can be stored and retrieved, a processor 1813, I/O interface 1814, and a communications interface 1817. I/O interface 814 supports connectivity to repository 1480 and input resource 1892.

Computer readable storage medium 1812 can be any hardware storage device such as memory, optical storage, hard drive, floppy disk, etc. In one embodiment, the computer readable storage medium 1812 stores instructions and/or data.

As shown, computer readable storage media 1812 can be encoded with fabrication management application 140-1 (e.g., including instructions) to carry out any of the operations as discussed herein.

During operation of one embodiment, processor 1813 accesses computer readable storage media 1812 via the use of interconnect 1811 in order to launch, run, execute, interpret or otherwise perform the instructions in fabrication management application 140-1 stored on computer readable storage medium 1812. Execution of the fabrication management application 140-1 produces fabrication management process 140-2 to carry out any of the operations and/or processes as discussed herein.

Those skilled in the art will understand that the computer system 1850 can include other processes and/or software and hardware components, such as an operating system that controls allocation and use of hardware resources to fabrication management application 140-1.

In accordance with different embodiments, note that computer system may be or included in any of various types of devices, including, but not limited to, a mobile computer, a personal computer system, a wireless device, base station, phone device, desktop computer, laptop, notebook, netbook computer, mainframe computer system, handheld computer, workstation, network computer, application server, storage device, a consumer electronics device such as a camera, camcorder, set top box, mobile device, video game console, handheld video game device, a peripheral device such as a switch, modem, router, set-top box, content management device, handheld remote control device, any type of computing or electronic device, etc. The computer system 850 may reside at any location or can be included in any suitable resource in any network environment to implement functionality as discussed herein.

Functionality supported by the different resources will now be discussed via flowcharts in FIG. 19. Note that the steps in the flowcharts below can be executed in any suitable order.

Figure 19:
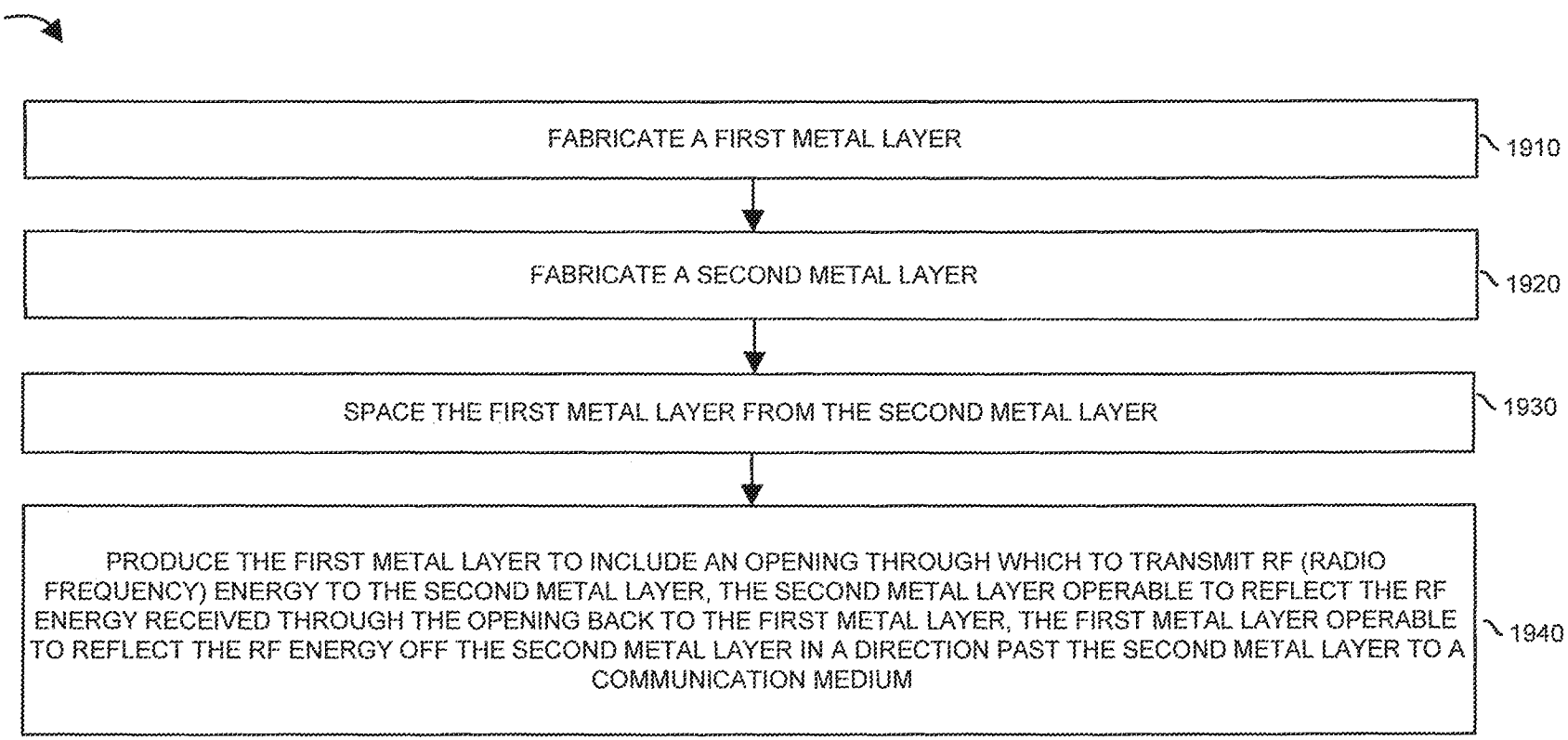
FIG. 19 is an example diagram illustrating a method according to embodiments herein.

FIG. 19 is a flowchart 1900 illustrating an example method according to embodiments. Note that there will be some overlap with respect to concepts as discussed above.

In processing operation 1910, a fabricator (such as executing the fabrication management application 140-1) of antenna device 100 fabricates first metal layer 120-1 such as on substrate 160.

In processing operation 1920, the fabricator fabricates second metal layer 120-2 such as on substrate 170.

In processing operation 1930, the fabricator spaces the first metal layer 120-1 from the second metal layer 120-2.

In processing operation 1940, the fabricator produces the first metal layer 120-1 to include an opening (slot 141) through which to transmit RF energy to the second metal layer 120-2. The second metal layer 120-2 is operable to reflect the RF energy received through the opening back to the first metal layer 120-1. The metal layer 120-1 is operable to reflect the RF energy reflected off the second metal layer in a direction past the second metal layer 120-2 to a communication medium.

FURTHER EXAMPLE EMBODIMENTS

Note that further embodiments herein include any of one or more of the following limitations.

For example, further embodiments herein include a method comprising:

fabricating a first metal layer; fabricating a second metal layer; spacing the first metal layer from the second metal layer; and producing the first metal layer to include an opening through which to transmit RF (Radio Frequency) energy to the second metal layer, the second metal layer operable to reflect the RF energy received through the opening back to the first metal layer, the first metal layer operable to reflect the RF energy off the second metal layer in a direction past the second metal layer to a communication medium.

In one embodiment, the method further comprises: fabricating a surface area of the first metal layer to be orthogonal to a direction in which to receive the RF energy through the opening, the surface area of the first metal layer being sufficiently larger than a surface area of the second metal layer to reflect the RF energy past the second metal layer to the communication medium.

In accordance with further embodiments, the method further comprises:

fabricating a surface area of the first metal layer to be substantially greater than a surface area of the second metal layer, the first metal layer and the second metal layer fabricated to be planar and disposed in parallel with respect to each other.

In accordance with yet further embodiments, a surface area of the first metal layer is at least 3 times greater than a surface area of the second metal layer.

In accordance with further embodiments, the method includes: fabricating a surface area of the first metal layer to be sufficiently larger than a surface area of the second metal layer such that the combination of the first metal layer and the second metal layer operate in a non-resonant operational mode.

In still further embodiments, the opening is a slot, the method further comprising: disposing the second metal layer directly above the slot.

In still further embodiments, the slot is fabricated to be wider than the second metal surface.

Further method embodiments herein include disposing a lengthwise axis of the slot to be disposed perpendicular to a transmission line on which the RF energy is conveyed from a driver circuit to the opening.

In accordance with yet further embodiments, the method includes: fabricating a thickness of a spacer separating the first metal layer and the second metal layer to be less than 25% of a wavelength of the RF energy received through the opening.

In accordance with further embodiments, the method includes disposing the first metal layer on a printed circuit board.

In accordance with further embodiments, the method includes: fabricating a combination of the first metal layer and the second metal layer combine to form a directional antenna in which a main lobe of the directional antenna extends in an orthogonal direction from a planar surface of the first metal layer.

In yet further embodiments, the second metal layer is fabricated as a patch antenna element configured to operate in a reflective mode.

In accordance with still further embodiments, the method includes: coupling the first metal layer to a ground reference voltage; receiving a substrate including a first facing and a second facing; and disposing the first metal layer on the first facing of the substrate; disposing a feed ling on the second facing, the feed line operable to convey a signal to the opening to transmit the RF energy.

Yet further method embodiments herein include:

fabricating a third metal layer to be spaced apart from the first metal layer; and disposing a second opening in the first metal layer, the second opening operable to transmit second RF (Radio Frequency) energy to the third metal layer, the third metal layer operable to reflect the second RF energy received through the second opening back to the first metal layer, the first metal layer operable to reflect the second RF energy from the third metal layer in a direction past the third metal layer to the communication medium. In one embodiment, the third metal layer resides in a same plane as the second metal layer; and the first metal layer is planar, both the second metal layer and the third metal layer parallel to the first metal layer.

In accordance with still further embodiments, the method herein includes: disposing a substrate between the first metal layer and a combination of the second metal layer and the third metal layer; fabricating a fifth metal layer on the substrate to be disposed between the first metal layer and the third metal layer; and fabricating a sixth metal layer on the substrate to be disposed between the first metal layer and the fourth metal layer.

In yet further embodiments, a combination of the first opening, the first metal layer, and the second metal layer are operable to output the first RF energy at a first carrier frequency; and a combination of the second opening, the first metal layer, and the third metal layer are operable to support output the first RF energy at a second carrier frequency.

Yet further method embodiments herein include: fabricating the second metal layer as a first patch antenna element operable to support emission of the first RF energy; and fabricating the third metal layer as a second patch antenna element of multiple patch antenna elements that are collectively operable to support emission of the second RF energy. Additionally, method embodiments includes: fabricating the first patch antenna element to be substantially larger in surface area size than the second patch antenna element.

Note again that techniques as discussed herein are well suited for use in different types of antenna devices. However, it should be noted that embodiments herein are not limited to use in such applications and that the techniques discussed herein are well suited for other applications as well.

Based on the description set forth herein, numerous specific details have been set forth to provide a thorough understanding of claimed subject matter. However, it will be understood by those skilled in the art that claimed subject matter may be practiced without these specific details. In other instances, methods, apparatuses, systems, etc., that would be known by one of ordinary skill have not been described in detail so as not to obscure claimed subject matter. Some portions of the detailed description have been presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm as described herein, and generally, is considered to be a self-consistent sequence of operations or similar processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has been convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining" or the like refer to actions or processes of a computing platform, such as a computer or a similar electronic computing device, that manipulates or transforms data represented as physical electronic or magnetic quantities within memories, registers, or other information storage devices, transmission devices, or display devices of the computing platform.

While this disclosure has been particularly shown and described with references to preferred embodiments thereof, it will be understood by those skilled in the art that various changes in form and details may be made therein without departing from the spirit and scope of the present application as defined by the appended claims. Such variations are intended to be covered by the scope of this present application. As such, the foregoing description of embodiments of the present application is not intended to be limiting. Rather, any limitations to the invention are presented in the following claims.

We claim:

1. An apparatus comprising:

a first metal layer;

a second metal layer spaced apart from the first metal layer; and the first metal layer including an opening through which to transmit RF (Radio Frequency) energy to the second metal layer, the second metal layer being an element overlapping and disposed opposite and aligned with the opening in the first metal layer, the second metal layer operable to reflect the RF energy received through the opening back to the first metal layer, the first metal layer operable to reflect the RF energy from the second metal layer in a direction past the second metal layer to a communication medium.

2. The apparatus as in claim 1, wherein a surface area of the first metal layer is disposed orthogonal to a direction of receiving the RF energy through the opening, the surface area of the first metal layer being sufficiently larger than a surface area of the second metal layer to reflect the RF energy past the second metal layer to the communication medium.

3. The apparatus as in claim 1, wherein a surface area of the first metal layer is substantially greater than a surface area of the second metal layer, the first metal layer and the second metal layer being planar antenna elements disposed in parallel with respect to each other.

4. The apparatus as in claim 1, wherein a surface area of the first metal layer is at least 3 times greater than a surface area of the second metal layer.

5. The apparatus as in claim 1, wherein a surface area of the first metal layer is sufficiently larger than a surface area of the second metal layer such that the combination of the first metal layer and the second metal layer operate in a non-resonant radiation mode.

6. The apparatus as in claim 1, wherein the opening is a slot, the second metal layer disposed directly above the slot.

7. The apparatus as in claim 1, wherein a thickness of a spacer separating the first metal layer and the second metal layer is less than 25% of a wavelength of the RF energy received through the opening.

8. The apparatus as in claim 1, wherein the first metal layer is disposed on a printed circuit board.

9. The apparatus as in claim 1, wherein a combination of the first metal layer and the second metal layer combine to form a high gain, directional antenna device in which a main radiation lobe of the directional antenna device extends in an orthogonal direction from a planar surface of the first metal layer.

10. The apparatus as in claim 1, wherein the first metal layer is operable to convey at least a portion of the RF energy outside a periphery of the second metal layer to the communication medium.

11. The apparatus as in claim 1, wherein the element is a patch antenna element operative to reflect the RF energy received from the opening back to the first metal layer.

12. The apparatus as in claim 1, wherein the first metal layer is coupled to a ground reference voltage, the apparatus further comprising:

a substrate including a first facing and second facing, the first metal layer disposed on the first facing of the substrate, the second facing including a feed line operable to convey a signal to the opening to transmit the RF energy.

13. The apparatus as in claim 1, wherein a combination of the first metal layer and the second metal layer is an antenna device, the antenna device being a feeding antenna.

14. The apparatus as in claim 1, wherein the first metal layer and the second metal layer operate in a non-resonant radiation mode of transmitting the RF energy passed the second metal layer to the communication medium.

15. The apparatus as in claim 14, wherein the first metal layer is operable to reflect RF energy from the second metal layer in which the reflected energy passes outside a periphery of the second metal layer during the non-resonant radiation mode.

16. The apparatus as in claim 1, wherein a ratio of a surface area of the first metal layer to a surface area of the second metal layer is sufficiently large that the apparatus operates in a reflective mode instead of a resonant mode.

17. The apparatus as in claim 1 further comprising:

dielectric material disposed between the first metal layer and the second metal layer, the second metal layer including only the element and no other elements spaced apart from the first metal layer via the dielectric material.

18. The apparatus as in claim 9, wherein the high gain, directional antenna device is operative to produce a second radiation lobe with respect to the main radiation lobe, the second radiation lobe being a direction opposite the main radiation lobe.

19. The apparatus as in claim 1, wherein a combination of the first metal layer and the second metal layer have a radiation aperture efficiency of emitting the RF energy of greater than 90%.

20. The apparatus as in claim 1, wherein a length of the opening as measured with respect to a first axis is greater than a width of the element as measured with respect to the first axis.

21. The apparatus as in claim 20, wherein a width of the opening as measured with respect to a second axis is less than a width of the element as measured with respect to the second axis.

22. The apparatus as in claim 21, wherein the second axis is orthogonal to the first axis, the apparatus further comprising:

a feed line extending along the second axis to the opening, the feed line conveying the RF energy to the opening.

23. The apparatus as in claim 22, wherein the opening is a slot.

24. The apparatus as in claim 1, wherein the opening is a slot; and wherein the first metal layer and the second metal layer operate in a non-resonant radiation mode of transmitting the RF energy passed the second metal layer to the communication medium.

25. The apparatus as in claim 1, wherein a length of the opening extends beyond the second metal layer.

26. The apparatus as in claim 25, wherein the second metal layer extends beyond a width of the opening.

27. An apparatus comprising:

a first metal layer;

a second metal layer spaced apart from the first metal layer; and the first metal layer including an opening through which to transmit RF (Radio Frequency) energy to the second metal layer, the second metal layer operable to reflect the RF energy received through the opening back to the first metal layer, the first metal layer operable to reflect the RF energy from the second metal layer in a direction past the second metal layer to a communication medium;

wherein the opening is a slot, the second metal layer disposed directly above the slot; and ac wherein the slot is wider than the second metal layer.

28. The apparatus as in claim 27, wherein a lengthwise axis of the slot is disposed perpendicular to a transmission line on which the RF energy is conveyed from a driver circuit to the opening.

29. An apparatus comprising:

a first metal layer;

a second metal layer spaced apart from the first metal layer; and the first metal layer including an opening through which to transmit RF (Radio Frequency) energy to the second metal layer, the second metal layer operable to reflect the RF energy received through the opening back to the first metal layer, the first metal layer operable to reflect the RF energy from the second metal layer in a direction past the second metal layer to a communication medium;

wherein the opening is a first opening in the first metal layer;

wherein the RF energy is first RF energy, the apparatus further comprising:

a third metal layer spaced apart from the first metal layer; and a second opening disposed in the first metal layer, the second opening operable to transmit second RF (Radio Frequency) energy to the third metal layer, the third metal layer operable to reflect the second RF energy received through the second opening back to the first metal layer, the first metal layer operable to reflect the second RF energy from the third metal layer in a direction past the third metal layer to the communication medium.

30. The apparatus as in claim 29, wherein the third metal layer resides in a same plane as the second metal layer; and wherein the first metal layer is planar, both the second metal layer and the third metal layer parallel to the first metal layer.

31. The apparatus as in claim 30 further comprising:

a substrate disposed between the first metal layer and a combination of the second metal layer and the third metal layer;

a fourth metal layer disposed between the first metal layer and the third metal layer; and a fifth metal layer disposed between the first metal layer and the fourth metal layer.

32. The apparatus as in claim 29, wherein a combination of the first opening, the first metal layer, and the second metal layer are operable to output the first RF energy at a first carrier frequency band; and wherein a combination of the second opening, the first metal layer, and the third metal layer are operable to support output of the second RF energy at a second carrier frequency band.

33. The apparatus as in claim 32, wherein the second metal layer is a first patch antenna element operable to support emission of the first RF energy; and wherein the third metal layer is a second patch antenna element of multiple patch antenna elements that are collectively operable to support emission of the second RF energy.

34. The apparatus as in claim 33, wherein the first patch antenna element is substantially larger in surface area size than the second patch antenna element.

* * * * *